US009569916B2

(12) United States Patent
Berman et al.

(10) Patent No.: US 9,569,916 B2
(45) **Date of Patent: *Feb. 14, 2017**

(54) GAMING METHOD AND APPARATUS FOR FACILITATING A GAME INVOLVING 2D AND 3D PLAY AREAS

(71) Applicant: KING SHOW GAMES, INC., Minnetonka, MN (US)

(72) Inventors: Bradley Berman, Minnetonka, MN (US); Jason Malkovich, Brooklyn Park, MN (US); Rebecca Schuh, Long Grove, IL (US); Chad Shapiro, Plymouth, MN (US); Adam Martin, St. Louis Park, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/754,676

(22) Filed: Jun. 29, 2015

(65) Prior Publication Data

US 2015/0302688 A1 Oct. 22, 2015

Related U.S. Application Data

(63) Continuation of application No. 12/850,840, filed on Aug. 5, 2010, now Pat. No. 9,070,259.

(60) Provisional application No. 61/231,596, filed on Aug. 5, 2009.

(51) Int. Cl.
*G07F 17/32* (2006.01)
*G07F 17/34* (2006.01)

(52) U.S. Cl.
CPC ..... *G07F 17/3213* (2013.01); *G07F 17/3202* (2013.01); *G07F 17/34* (2013.01)

(58) Field of Classification Search
CPC .. G07F 17/34; G07F 17/3213; G07F 17/3202; G07F 17/32
See application file for complete search history.

(56) References Cited

U.S. PATENT DOCUMENTS

| | | | | |
|---|---|---|---|---|
| 5,611,535 | A | 3/1997 | Tiberio | |
| 5,890,962 | A | 4/1999 | Takemoto | |
| 6,004,208 | A | 12/1999 | Takemoto et al. | |
| 6,093,102 | A | 7/2000 | Bennett | |
| 6,123,333 | A | 9/2000 | McGinnis et al. | |
| 6,200,217 | B1 | 3/2001 | Osawa | |
| 6,227,971 | B1 | 5/2001 | Weiss | |
| 6,241,607 | B1 | 6/2001 | Payne et al. | |
| 6,261,178 | B1 | 7/2001 | Bennett | |
| 6,398,218 | B1 | 6/2002 | Vancura | |
| 6,746,329 | B1 | 6/2004 | Duhamel | |
| 6,887,157 | B2 | 5/2005 | LeMay et al. | |
| 6,896,615 | B2 * | 5/2005 | Berman | G07F 17/34 273/143 R |

(Continued)

*Primary Examiner* — Jasson Yoo

(57) ABSTRACT

Various embodiments are disclosed concerning games that use both 2D and 3D play areas. Various embodiments concern representing a 3D structure composed of a plurality of 3D shapes having a plurality of faces, presenting a plurality of elements, marking the plurality of faces and the elements, identifying a first set of one or more combinations of corresponding markings, moving the shapes of the three dimensional structure relative to the elements, and identifying a second set of one or more combinations of corresponding markings, each of the combinations of corresponding markings from the first set and the second set composed of markings from at least one of the elements and multiple faces of the shapes.

20 Claims, 9 Drawing Sheets

(56) References Cited

U.S. PATENT DOCUMENTS

| | | | |
|---|---|---|---|
| 6,932,700 | B2 | 8/2005 | Bennett et al. |
| 6,960,133 | B1 | 11/2005 | Marks et al. |
| 7,128,647 | B2 | 10/2006 | Muir |
| 7,252,591 | B2 * | 8/2007 | Van Asdale ..... G07F 17/3262 463/20 |
| 7,510,478 | B2 | 3/2009 | Benbrahim et al. |
| 2002/0111204 | A1 | 8/2002 | Lupo |
| 2003/0148803 | A1 | 8/2003 | Lupo |
| 2004/0002380 | A1 | 1/2004 | Brosnan et al. |
| 2004/0043812 | A1 | 3/2004 | Ellis |
| 2004/0053686 | A1 | 3/2004 | Pacey et al. |
| 2004/0077401 | A1 | 4/2004 | Schlottmann |
| 2004/0077402 | A1 | 4/2004 | Schlottmann |
| 2004/0102244 | A1 | 5/2004 | Kryuchkov et al. |
| 2004/0192430 | A1 | 9/2004 | Burak et al. |
| 2005/0037843 | A1 | 2/2005 | Wells et al. |
| 2005/0059487 | A1 | 3/2005 | Wilder et al. |
| 2005/0075167 | A1 | 4/2005 | Beaulieu et al. |
| 2007/0072665 | A1 | 3/2007 | Muir |
| 2008/0045322 | A1 | 2/2008 | Berman |
| 2008/0045323 | A1 | 2/2008 | Berman |
| 2008/0113775 | A1 | 5/2008 | Williams et al. |
| 2008/0220839 | A1 | 9/2008 | DeBrabander et al. |
| 2008/0234032 | A1 | 9/2008 | Courssou et al. |
| 2009/0061983 | A1 | 3/2009 | Kaufman |
| 2009/0062001 | A1 | 3/2009 | LeMay et al. |

* cited by examiner

GAMING METHOD AND APPARATUS FOR FACILITATING A GAME INVOLVING 2D AND 3D PLAY AREAS

RELATED APPLICATIONS

This application is a continuation of U.S. application Ser. No. 12/850,840, filed Aug. 5, 2010, now U.S. Pat. No. 9,070,259, which claims the benefit of Provisional Patent Application No. 61/231,596, filed on Aug. 5, 2009, to which priority is claimed pursuant to 35 U.S.C. §119(e), both of which are incorporated herein by reference in their entirety.

FIELD OF THE INVENTION

This invention relates in general to gaming systems and processes, and more particularly to gaming systems, methods and apparatuses for facilitating a game involving 2D and 3D play areas.

BACKGROUND

Gaming devices such as slot machines have entertained the public for over a century. While the fundamental concept behind slot games has remained relatively intact, the manners of computing, displaying, and participating in modern day slot games have changed dramatically. One force driving these changes is technological advancement, such as the advent of computers and video capabilities. Another driving force is human nature, as the participants of such gaming devices demand continual excitement and stimulation. It is therefore important in the gaming industry that gaming innovations continue to be rolled out to the participating public.

Conventional slot games and the like involve relatively linear game play that can become repetitive and monotonous for a player. For example, a conventional slot machine involves repeatedly spinning three reels in an attempt to line reel symbols up in an essentially two dimensional configuration that triggers a payout. While the outcome of each game is not predictable, the manner of game play is identical each time the game is played and is limited to two dimensional game play aspects. Such games can have limited ability in sustaining a player's interest as the game play over time.

SUMMARY

To overcome limitations in the prior art described above, and to overcome other limitations that will become apparent upon reading and understanding the present specification, the present invention discloses systems, apparatuses and methods for providing, among other features, games which include both two dimensional (2D) and three dimensional (3D) game play aspects.

Various embodiments concern presenting a representation of a three dimensional structure composed of a plurality of three dimensional shapes, each shape of the plurality having a plurality of faces; presenting a plurality of elements; marking the plurality of faces and the plurality of elements; identifying a first set of one or more combinations of corresponding markings, each of the combinations of corresponding markings from the first set composed of markings from at least one of the elements and multiple faces of the shapes; moving the shapes of the three dimensional structure relative to the elements; and identifying a second set of one or more combinations of corresponding markings, each of the combinations of corresponding markings from the second set composed of markings from at least one of the elements and multiple faces of the shapes.

In such embodiments as above, moving the shapes of the three dimensional structure can comprise rotating the three dimensional structure while maintaining the relative positioning of the shapes and the faces of the shapes.

In such embodiments as above, the shapes of the three dimensional structure can be arranged in a plurality of layers, each layer composed of multiple of the shapes, and the plurality of layers represents a depth dimension along which the elements have a single layer.

In such embodiments as above, the one or more combinations of markings from the second set can comprise a series of markings located on faces of multiple layers of the three dimensional structure.

In such embodiments as above, identifying the first set of one or more combinations of corresponding markings can comprise evaluating all of the faces that face the same direction as the plurality of elements to identify one or more combinations of markings that correspond to payouts of a paytable; moving the shapes of the three dimensional structure relative to the elements can change which faces of the three dimensional shapes face the same direction as the plurality of elements; and identifying the second set of one or more combinations of corresponding markings can comprise evaluating all of the faces that face the same direction as the plurality of elements to identify one or more combinations of markings that correspond to payouts of the paytable.

In such embodiments as above, the three dimensional structure can be a cube and each of the shapes can be a cube. Further, moving the shapes of the three dimensional structure can comprise rotating the cube; the first set of one or more combinations of corresponding markings can comprise markings from a first face of the cube; and the second set of one or more combinations of corresponding markings can comprise markings from a second face of the cube.

In such embodiments as above, the three dimensional shapes of the three dimensional structure can be arranged in a plurality of layers in the cube, each layer composed of multiple of the shapes and the plurality of layers representing a depth dimension along which the elements have a single layer; moving the shapes of the three dimensional structure can comprise rotating the cube; the first set of one or more combinations of corresponding markings can comprise markings on faces of different layers of the three dimensional structure in a first orientation of the cube with respect to the elements; and the second set of one or more combinations of corresponding markings can comprise markings on faces of different layers of the three dimensional structure in a second orientation of the cube with respect to the elements.

In such embodiments as above, the three dimensional structure can be a single layer array of the plurality of three dimensional shapes.

In such embodiments as above, the plurality of elements can comprise a first group of elements and a second group of elements, the first and the second groups of elements positioned on opposing sides of the three dimensional structure; each of the combinations of corresponding markings from the first set can be composed of at least one marking from each of the first group of elements and the second group of elements, each combination of markings from the first set spanning the three dimensional structure; and each of the combinations of corresponding markings from the second set can be composed of at least one marking from each of the first group of elements and the second group of elements, each combination of markings from the second set spanning the three dimensional structure.

In such embodiments as above, each of the combinations of corresponding markings from the first set can correspond based on each of the markings being of a first common type and each of the combinations of corresponding markings from the second set can corresponding based on each of the markings being of a second common type.

In such embodiments as above, marking the plurality of faces and the plurality of elements can comprise randomly selecting respective marking-types for each of the faces and elements from a plurality of different marking-types.

Various embodiments concern a computer-readable medium having instructions stored thereon which are executable by the processor for facilitating a game performing steps comprising: presenting a representation of a three dimensional structure composed of a plurality of three dimensional shapes, each shape of the plurality having a plurality of faces; presenting a plurality of elements; marking the plurality of faces and the plurality of elements; identifying a first set of one or more combinations of corresponding markings, each of the combinations of corresponding markings from the first set composed of markings from at least one of the elements and multiple faces of the shapes; moving the shapes of the three dimensional structure relative to the elements; and identifying a second set of one or more combinations of corresponding markings, each of the combinations of corresponding markings from the second set composed of markings from at least one of the elements and multiple faces of the shapes.

In such embodiments as above, the computer-readable medium can further have instructions stored thereon which are executable by the processor for facilitating the game such that moving the shapes of the three dimensional structure comprises rotating the three dimensional structure while maintaining the relative positioning of the shapes and the faces of the shapes.

In such embodiments as above, the computer-readable medium can further have instructions stored thereon which are executable by the processor for facilitating the game such that the shapes of the three dimensional structure are arranged in a plurality of layers, each layer composed of multiple of the shapes, and the plurality of layers represents a depth dimension along which the elements have a single layer.

In such embodiments as above, the computer-readable medium can further have instructions stored thereon which are executable by the processor for facilitating the game such that the one or more combinations of markings from the second set comprises a series of markings located on faces of multiple layers of the three dimensional structure.

In such embodiments as above, the computer-readable medium can further have instructions stored thereon which are executable by the processor for facilitating the game such that: identifying the first set of one or more combinations of corresponding markings comprises evaluating all of the faces that face the same direction as the plurality of elements to identify one or more combinations of markings that correspond to payouts of a paytable; moving the shapes of the three dimensional structure relative to the elements changes which faces of the three dimensional shapes face the same direction as the plurality of elements; and identifying the second set of one or more combinations of corresponding markings comprises evaluating all of the faces that face the same direction as the plurality of elements to identify one or more combinations of markings that correspond to payouts of the paytable.

In such embodiments as above, the computer-readable medium can further have instructions stored thereon which are executable by the processor for facilitating the game such that the three dimensional structure is a cube and each of the shapes is a cube.

In such embodiments as above, the computer-readable medium can further have instructions stored thereon which are executable by the processor for facilitating the game such that: moving the shapes of the three dimensional structure comprises rotating the cube; the first set of one or more combinations of corresponding markings comprises markings from a first face of the cube; and the second set of one or more combinations of corresponding markings comprises markings from a second face of the cube.

In such embodiments as above, the computer-readable medium can further have instructions stored thereon which are executable by the processor for facilitating the game such that: the three dimensional shapes of the three dimensional structure are arranged in a plurality of layers in the cube, each layer composed of multiple of the shapes and the plurality of layers representing a depth dimension along which the elements have a single layer; moving the shapes of the three dimensional structure comprises rotating the cube; the first set of one or more combinations of corresponding markings comprises markings on faces of different layers of the three dimensional structure in a first orientation of the cube with respect to the elements; and the second set of one or more combinations of corresponding markings comprises markings on faces of different layers of the three dimensional structure in a second orientation of the cube with respect to the elements.

In such embodiments as above, the computer-readable medium can further have instructions stored thereon which are executable by the processor for facilitating the game such that the three dimensional structure is a single layer array of the plurality of three dimensional shapes.

In such embodiments as above, the computer-readable medium can further have instructions stored thereon which are executable by the processor for facilitating the game such that: the plurality of elements comprises a first group of elements and a second group of elements, the first and the second groups of elements positioned on opposing sides of the three dimensional structure; each of the combinations of corresponding markings from the first set is composed of at least one marking from each of the first group of elements and the second group of elements, each combination of markings from the first set spanning the three dimensional structure; and each of the combinations of corresponding markings from the second set is composed of at least one marking from each of the first group of elements and the second group of elements, each combination of markings from the second set spanning the three dimensional structure.

In such embodiments as above, the computer-readable medium can further have instructions stored thereon which are executable by the processor for facilitating the game such that each of the combinations of corresponding markings from the first set correspond based on each of the markings being of a first common type and each of the combinations of corresponding markings from the second set corresponding based on each of the markings being of a second common type.

In such embodiments as above, the computer-readable medium can further have instructions stored thereon which are executable by the processor for facilitating the game such that marking the plurality of faces and the plurality of elements comprises randomly selecting respective marking-types for each of the faces and elements from a plurality of different marking-types.

Various embodiments concern a gaming apparatus for facilitating a game comprising: a display device; and circuitry configured to: facilitate presentation of a representation of a three dimensional structure composed of a plurality of three dimensional shapes, each shape of the plurality having a plurality of faces and a plurality of elements on the display device; control marking the plurality of faces and the plurality of elements; identify a first set of one or more combinations of corresponding markings, each of the combinations of corresponding markings from the first set composed of markings from at least one of the elements and multiple faces of the shapes; facilitate movement of the shapes of the three dimensional structure relative to the elements on the display device; and identify a second set of one or more combinations of corresponding markings, each of the combinations of corresponding markings from the second set composed of markings from at least one of the elements and multiple faces of the shapes.

In such gaming apparatus embodiments as above, the circuitry can be configured such that movement of the shapes of the three dimensional structure comprises rotating the three dimensional structure while maintaining the relative positioning of the shapes and the faces of the shapes.

In such gaming apparatus embodiments as above, the circuitry can be configured such that the shapes of the three dimensional structure are arranged in a plurality of layers, each layer composed of multiple of the shapes, and the plurality of layers represents a depth dimension along which the elements have a single layer.

In such gaming apparatus embodiments as above, the circuitry can be configured such that the one or more combinations of markings from the second set comprises a series of markings located on faces of multiple layers of the three dimensional structure.

In such gaming apparatus embodiments as above, the circuitry can be configured such that identifying the first set of one or more combinations of corresponding markings comprises evaluating all of the faces that face the same direction as the plurality of elements to identify one or more combinations of markings that correspond to payouts of a paytable; moving the shapes of the three dimensional structure relative to the elements changes which faces of the three dimensional shapes face the same direction as the plurality of elements; and identifying the second set of one or more combinations of corresponding markings comprises evaluating all of the faces that face the same direction as the plurality of elements to identify one or more combinations of markings that correspond to payouts of the paytable.

In such gaming apparatus embodiments as above, the circuitry can be configured such that the three dimensional structure is a cube and each of the shapes is a cube.

In such gaming apparatus embodiments as above, the circuitry can be configured such that moving the shapes of the three dimensional structure comprises rotating the cube; the first set of one or more combinations of corresponding markings comprises markings from a first face of the cube; and the second set of one or more combinations of corresponding markings comprises markings from a second face of the cube.

In such gaming apparatus embodiments as above, the circuitry can be configured such that the three dimensional shapes of the three dimensional structure are arranged in a plurality of layers in the cube, each layer composed of multiple of the shapes and the plurality of layers representing a depth dimension along which the elements have a single layer; moving the shapes of the three dimensional structure comprises rotating the cube; the first set of one or more combinations of corresponding markings comprises markings on faces of different layers of the three dimensional structure in a first orientation of the cube with respect to the elements; and the second set of one or more combinations of corresponding markings comprises markings on faces of different layers of the three dimensional structure in a second orientation of the cube with respect to the elements.

In such gaming apparatus embodiments as above, the circuitry can be configured such that the three dimensional structure is a single layer array of the plurality of three dimensional shapes.

In such gaming apparatus embodiments as above, the circuitry can be configured such that the plurality of elements comprises a first group of elements and a second group of elements, the first and the second groups of elements positioned on opposing sides of the three dimensional structure; each of the combinations of corresponding markings from the first set is composed of at least one marking from each of the first group of elements and the second group of elements, each combination of markings from the first set spanning the three dimensional structure; and each of the combinations of corresponding markings from the second set is composed of at least one marking from each of the first group of elements and the second group of elements, each combination of markings from the second set spanning the three dimensional structure.

In such gaming apparatus embodiments as above, the circuitry can be configured such that each of the combinations of corresponding markings from the first set correspond based on each of the markings being of a first common type and each of the combinations of corresponding markings from the second set corresponding based on each of the markings being of a second common type.

In such gaming apparatus embodiments as above, the circuitry can be configured such that marking the plurality of faces and the plurality of elements comprises randomly selecting respective marking-types for each of the faces and elements from a plurality of different marking-types.

Various embodiments concern a gaming apparatus for facilitating a game comprising: means for presenting a representation of a three dimensional structure composed of a plurality of three dimensional shapes, each shape of the plurality having a plurality of faces; means for presenting a plurality of elements; means for marking the plurality of faces and the plurality of elements; means for identifying a first set of one or more combinations of corresponding markings, each of the combinations of corresponding markings from the first set composed of markings from at least one of the elements and multiple faces of the shapes; means for moving the shapes of the three dimensional structure relative to the elements; and means for identifying a second set of one or more combinations of corresponding markings, each of the combinations of corresponding markings from the second set composed of markings from at least one of the elements and multiple faces of the shapes.

In such gaming apparatus embodiments as above, the shapes of the three dimensional structure can be arranged in a plurality of layers, each layer composed of multiple of the shapes; the plurality of layers can represent a depth dimension along which the elements have a single layer; identifying the first set of one or more combinations of corresponding markings can comprise evaluating all of the faces that face the same direction as the plurality of elements to identify one or more combinations of markings that correspond to payouts of a paytable; moving the shapes of the three dimensional structure relative to the elements can change which faces of the three dimensional shapes face the same direction as the plurality of elements; and identifying the second set of one or more combinations of corresponding markings can comprise evaluating all of the faces that face the same direction as the plurality of elements to identify one or more combinations of markings that correspond to payouts of the paytable.

These and various other advantages and features of novelty which characterize the invention are pointed out with particularity in the claims annexed hereto and form a part hereof. However, for a better understanding of the invention, its advantages, and the objects obtained by its use, reference should be made to the drawings which form a further part hereof, and to accompanying descriptive matter, in which there are illustrated and described specific examples of an apparatus in accordance with the invention.

BRIEF DESCRIPTION OF THE DRAWINGS

The invention is described in connection with the embodiments illustrated in the following diagrams.

DETAILED DESCRIPTION OF THE ILLUSTRATED EMBODIMENTS

Figure 1A:
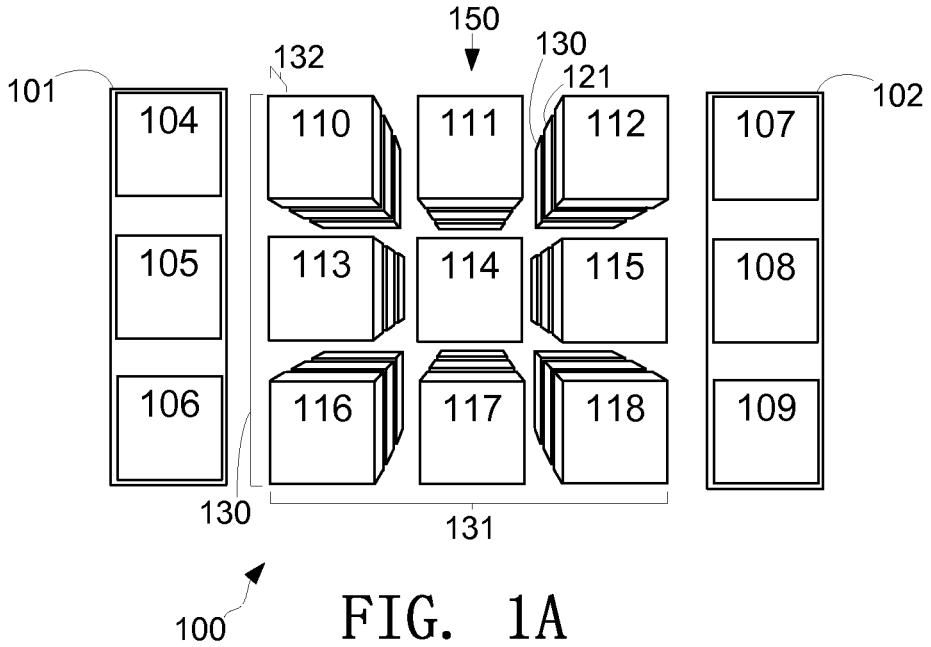
FIGS. 1A-H illustrates an embodiment of a gaming activity spanning 2D and 3D play areas in accordance with aspects of the invention.

In the following description of the invention, reference is made to the accompanying drawings which form a part hereof, and in which is shown by way of illustration the specific embodiment in which the invention may be practiced. It is to be understood that other embodiments may be utilized, as structural and operational changes may be made without departing from the scope of the present invention.

In conventional slot machine gaming, a player watches for alignment of a series of symbols to trigger payouts, such as horizontal alignment of three cherry symbols in a 2D grid comprised of 2D elements. The symbols are typically presented on a plurality of spinning reels (actual reels or graphically depicted reels) and the relative positioning of the reels after spinning determines the symbol alignment and payouts associated with symbol series formation. Such 2D games have no aspect of depth in game play, such as game play in a third dimension. This conventional game play can become monotonous for a player because the player is essentially looking for one thing as the reels slow down—the alignment of symbols in an essentially 2D environment.

3D embodiments can also suffer from the same drawbacks as conventional 2D based games. Even though game play is extended to a third dimension, such as a depth dimension, the player is still looking for the alignment of symbols within the 3D environment. The present disclosure provides game play aspects which are not purely 2D or 3D, and includes game concepts that transition between 2D and 3D play areas for a gaming dynamic not found in conventional game play. In contrast to the lining up of multiple symbols in just a 2D or 3D environment, various game aspects of the present disclosure include winning series of markings that span between 2D and 3D play areas.

FIGS. 1A-H illustrates a gaming embodiment employing aspects of the present disclosure. The embodiment of FIGS. 1A-H includes a play area 100 composed of two columns 101 and 102 of elements 104-109 surrounding a 3D cube 150. The columns 101 and 102 are on opposite sides of the 3D cube 150.

The 3D cube 150 is composed of 27 3D shapes (themselves cubes) arranged to give the 3D cube height 130, width 131, and depth 132 dimensions. The 3D cube 150 is three 3D shapes deep in each of these height 130, width 131, and depth 132 dimensions. The front of the 3D cube 150 shows 3D shapes 110-118, which includes a vertical stack of 3D shapes 110, 113, and 116 and a horizontal stack of 3D shapes 110, 111, 112. Behind each of the 3D shapes 110-118 on the front of the 3D cube 150 are two more 3D shapes, although those 3D shapes are partially or totally obscured in this view of the play area 100. For example, 3D shapes 121 and 130 are behind 3D shape 112 and two more 3D shapes are totally obscured by 3D shape 114.

The play area 100 is arranged such that the front of the 3D cube 150 is aligned coplanar with the 2D columns 101 and 102. For a further illustration of the alignment of a front of a 3D cube and 2D columns 101 and 102, see FIG. 2. The 3D cube 150 has a total of six faces, as do each of the 3D shapes forming the 3D cube 150. However, only one of the faces of the 3D cube 150, and one of the faces of each of the 3D shapes forming the 3D cube 150, will face the same direction as the 2D elements 104-109 and align parallel with the 2D elements at a time.

It is contemplated that the 3D cube 150 could be of any size, containing different amounts of 3D shapes. For example, the 3D cube could have dimensions 130-132 of 2, 4, 5, or 6 3D shapes, or some other number of 3D shapes, to create a different sized cube 150 or other shape.

In various embodiments, the 3D cube is replaced with a different 3D structure of 3D shapes, the 3D shapes themselves each also being something other than a cube. For example, the 3D shapes could form a pyramid, rectangular solid, or more informal arrangement of 3D shapes to create a 3D structure. These other 3D structures could be positioned between the two columns 101 and 102 of 2D elements 104-109 such that a face of the 3D structure faces the same direction as the 2D elements 104-109. Additionally, or alternatively, the 3D shapes themselves could be other shapes (i.e. other than cubes) such as spheres, or rectangular solids, among other 3D shapes. In this and/or in other configurations, the 3D shapes (e.g., cubes or other 3D shape) forming the 3D structure can be arranged such that a face of each of the 3D shapes faces the same direction as the 2D elements 104-109, but are not necessarily co-planar with the columns 101 and 102 and 2D elements 104-109.

The elements of play area 100 are squares. However, according to various other embodiments of this disclosure, elements of could take the form of, but are not limited to, circles, ovals, triangles, pentagons, hexagons, octagons, and the like.

Although FIGS. 1A-H illustrate two columns 101 and 102 of elements, other arrangements could be used. For example, horizontal rows above and below the 3D shapes could alternatively or additionally, be used. A greater number of elements in the columns, and/or a greater number of columns, could be used. The two columns 101 and 102 need not be columns, but could be some other 2D shape composed of 2D elements, such as squares, rectangles, or more informal arrangements of elements. Two sections of elements need not be used for all embodiments, and in some embodiments a single section (e.g., a single column, row, or other shape) could be used. In some embodiments, the 2D arrangement of elements is a circuit of elements appearing to surround the 3D cube 150 from the perspective shown in FIG. 1A (e.g., a circuit of elements frame the 3D shapes).

The 2D columns 101 and 102 are identified as 2D because they lack a depth dimension 132. As such, the 2D elements 104-109 have a height dimension 130 and a width dimension 131 (because there are two columns along this dimension), but the 2D elements are limited to these two dimensions. It is noted that each 2D element could be illustrated to be three dimensional, such that each element has some thickness in the depth dimension 132, but the elements still function as 2D because there are not additional elements arrayed along the depth dimension 132. As such, dimension in this sense does not refer to physical or illustrated thickness in three dimensions, but rather the arraying of markable elements or faces which can be used to contribute to winning combinations of markings according to a pay table.

Figure 1B:
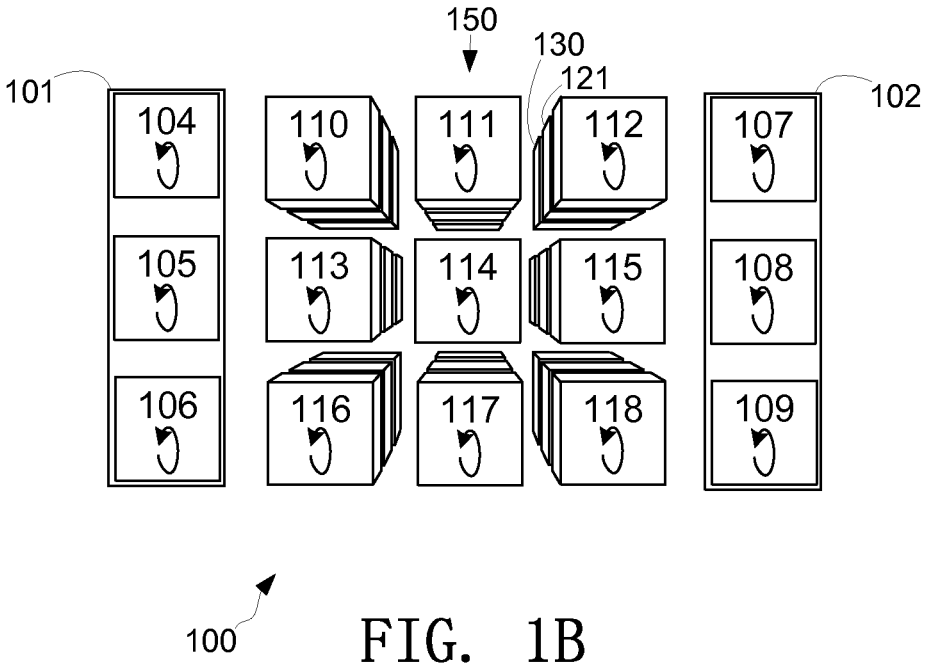

FIG. 1B shows a representation of the elements and faces of the play area 100 being marked. The circling arrow in each of the elements and faces represents the process of selection (e.g., random selection) of markings for representation in association with each of these elements.

Marking, as referred to herein, includes distinguishing at least one element or face of a 3D shape from at least one other element or face. Generally, marking involves placing a gaming symbol on each element and face, these symbols subsequently being used in combination to trigger a payout according to a pay table. There are many ways in which one element or face can be distinguished from another element or face, and therefore there are many different ways to mark elements and faces. For example, an element or face could be marked simply by it being created or located in an array or display area. Marking can also include placing and/or representing a symbol, one or more colors, flag, characters, images, graphics, numbers, letters, shapes, features, or designs on, or associated with, an element or face. Distinguishing of elements can be done to physical elements, such as element pieces of a board or on a reel strip. Distinguishing of elements and faces can also be done to elements represented on a display screen.

Marking can be done in various ways. For example, some elements and/or faces can be randomly marked, such that there is a probability that a particular element or face will be marked or not marked. Determining whether a particular element or face will be marked can be done by various means, including random number generation, as discussed herein. If an element or face is selected to be marked, then another step can be taken to determine which of the possible different types of markings will be used to mark the particular element or face. However, in some embodiments only one type of marking is available. Moreover, in some embodiments, a process is conducted to randomly select a particular marking for an element or face, and amongst the different marking outcomes that can be selected is an outcome where the element or face is not marked.

In some embodiments, only a certain number of elements and/or faces will be marked and some of the elements and/or faces will be left unmarked. An evaluation can then be conducted to determine whether, for example, a series of adjacent marked elements and faces was formed to calculate payouts. In some embodiments, all elements and faces of a particular type or area will be marked and a random number generator or other selection means will be used to determine the particular marking for each element of the type or area. It should be noted that "randomly" and "random" as used herein does not require pure randomness; e.g., the marking-types may be, and often are, weighted in some fashion. Thus, "random" or "randomly" as used herein refers to at least some degree of randomness.

Figure 1C:
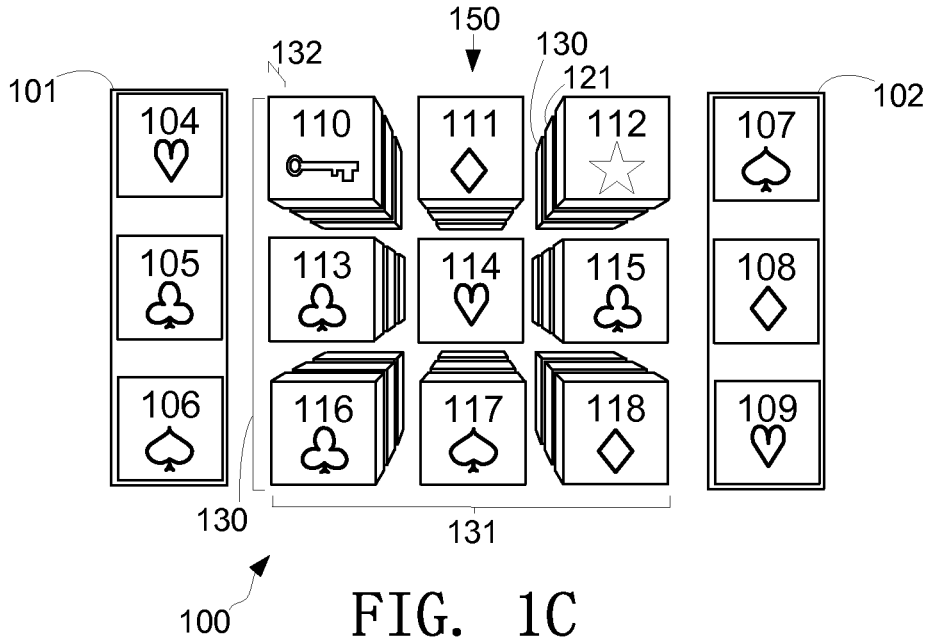

The results of marking are shown in FIG. 1C, where each element and front facing faces are shown to be marked with respective markings. For example, element 106 is marked with a spade marking, the front face of 3D shape 110 is marked with a key marking, and element 109 is marked with a heart marking. Various faces of 3D shapes are behind the 3D shapes 110-118 on the front of the 3D cube, and therefore their markings cannot be seen in FIG. 1C. All faces of the 3D shapes are nevertheless marked in the stage of game play shown in FIG. 1C. For example, the six markings for each of 3D shapes 121 and 130 are obscured by 3D shape 112, obscured by 3D shapes 121 and 130 themselves, and/or not facing the proper direction to be clearly seen. Even so, the 27 3D shapes of the 3D cube 150 have been marked, with one marking for each of the six faces for each 3D shape, for a total of 162 markings of the 3D cube 150.

In the embodiment of FIGS. 1A-H, a payout is triggered for each winning series of corresponding elements and faces spanning along the 3D cube 150 and between the element columns 101-102. Elements and faces can correspond by being marked with common marking-types, such as series of heart-markings on a series of elements and faces. In various embodiments, the series must be composed of elements and faces that are adjacent to one another in a 2D sense, even though a 3D arrangement of faces is used. If marked with common markings, then such a series of elements and faces could be 104-110-111-112-107. Because the elements and faces need only be adjacent in a 2D sense, then the faces in the deeper layers (along depth 132, such as a front face of 3D shape 130) could be adjacent to faces in the first layer of 3D shapes (e.g., front face of 3D shape 111) if otherwise adjacent by height 130 and width 131 dimensions (the front faces of 3D shapes 111 and 130 are adjacent because they are next to each other along dimensions 130 and 131, even if not along dimension 132). For example, if commonly marked, then such a payout triggering series could be composed of front faces of 3D shapes 110-111-121 between elements 104 and 107 or front faces of 3D shapes 113-111-130 between elements 105 and 108. However, FIG. 1C shows no such series that is commonly marked.

Figure 1D:
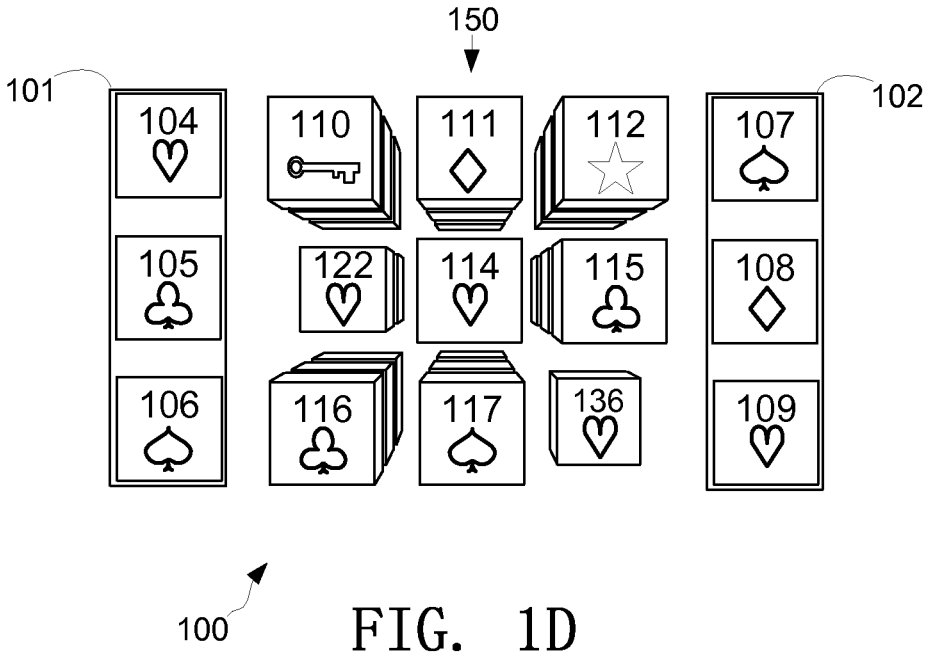
Figure 1E:
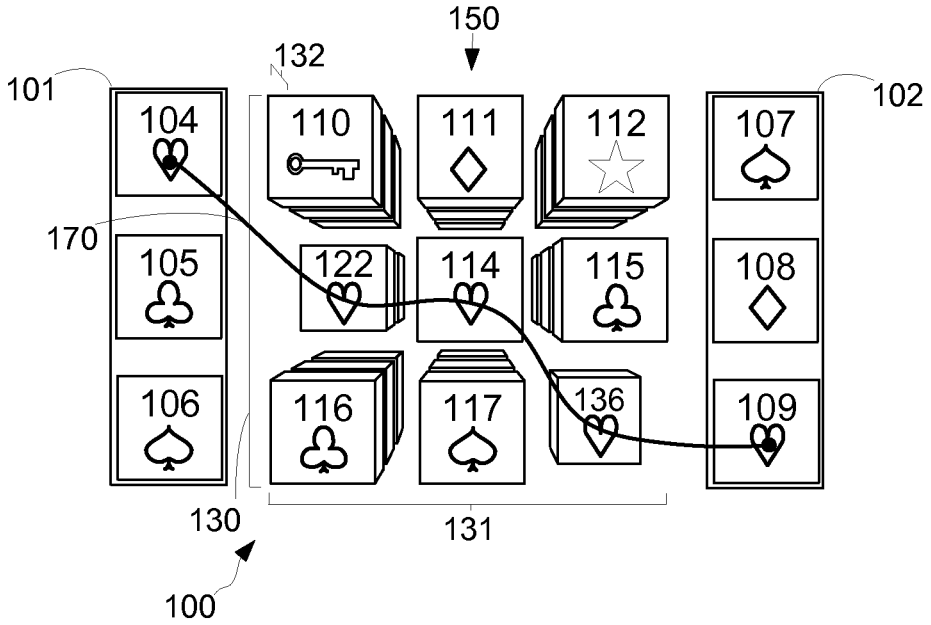

The front face of 3D shape 122 is more visible in FIG. 1D as compared to FIG. 1C because 3D shape 113, previously partially obscuring 3D shape 122, is not shown in FIG. 1D. 3D shape 118 has also been made invisible, as well as the 3D shape 127 immediately behind 3D shape 118 to show the front face of 3D shape 136 displaying a heart marking. The appearance of 3D shapes can be removed in this way to show markings of faces that form a series of corresponding elements and faces that trigger a payout according to a pay table. FIG. 1E shows line 170 tracing a series of corresponding elements and faces that trigger a payout. The series is composed of heart markings from elements 104 and 109 and faces of 3D shapes 122-114-136. This series spans between the 2D element columns 101 and 102 and along the 3D cube 150, which is a condition of forming winning combinations in this and various other embodiments. In this way, a series of corresponding elements and faces must span between along a 3D portion between two 2D portions. In the 2D portion, the possible markings for each element is limited to the marking on the 2D element, while in the 3D portion one of several faces from each 3D shape stack can be used.

While elements 104 and 109 and faces of 3D shapes 122, 114, and 136 correspond to one another by each having an identical marking, there are various other ways in which elements and faces can correspond to one another, according to various embodiments. For example, elements and faces could correspond to one another not by having the same mark, but rather by just having a mark (e.g., as in embodiments were only some of the elements and faces are marked). But in some embodiments, elements and faces will only correspond if they have the same letter, number, symbol, image, color, or other similar marking. In some embodiments, elements and faces will correspond if they are marked with markings selected from a particular group, and the elements and faces need not all have identical markings to correspond to one another. For example, elements and faces may correspond to one another because each is marked with an image of a dog, even though all image markings on the elements and faces are of a different breed of dog.

In some embodiments, elements and faces correspond to one another if their markings form a progressive series. In such embodiments, adjacent elements and faces might only correspond if they are marked with consecutive numbering. In other embodiments, letter marked elements and faces and may only correspond if the adjacent elements spell a word. In some embodiments, marked elements and faces may correspond if a word can be spelled from the marked elements of a series, regardless of whether the elements and faces are adjacent to one another.

Element 104 and the face of 3D shape 110 not only correspond to one another, but also help form a series of adjacently located elements. There are many different ways in which an element or face can be adjacent to another element and/or face. For example, two faces could be considered to be adjacent to one another if they share a common corner in the horizontal and vertical dimensions 131 and 130 (but in this and some other embodiments, proximity in a Z dimension 132 is not necessary, such that 3D shapes 114 and 136 are adjacent to one another). However, various embodiments do not consider the mere sharing of a corner to make two elements and/or faces adjacent.

Two elements and/or faces may share a common wall despite there being a small gap illustrated between the framing of each element and/or face, as in FIGS. 1A-H. Two square elements or two faces of two cubes may be adjacent in various embodiments because their respective proximate and opposing walls are aligned next to and along one another. Adjacency in this sense, for this particular embodiment, relates to the concept of how the elements and/or faces of a play area are orientated with respect to each other and not precisely how each element and/or face is illustrated.

According to various embodiments, elements and/or faces in contact with and/or within close proximity (e.g., next to) to one another can be considered to be adjacent. Elements and/or face can be in contact with one another by sharing walls, lines, points, segments, portions and/or features. Elements can also be in contact by overlapping each other. Other types of adjacency may be provided as well. For example, in one embodiment, only those elements and/or faces that are adjacent in a horizontal, vertical, or diagonal fashion will be deemed "adjacent" for purposes of providing a payout. Alternatively, only elements and/or faces that are horizontal, or that are vertical, or that are diagonal, may be deemed adjacent. Elements and/or faces may also be deemed adjacent along opposite edges of the play area, as if the edges were wrapped around to intersect with one another. Three dimensional display grids may also be used in accordance with the embodiments referenced herein, such that elements and/or faces sharing a wall, corner or segment may be considered to be adjacent.

In various embodiments, a series of corresponding adjacent elements and faces can be dynamically identified. Dynamic identification includes locating winning segments that can take any number of forms. As opposed to classic three reel strip slot matching, where a series of winning markings could only be formed along one row, dynamic identification allows segments to be formed in many other ways, including segments that repeatedly change direction along their length. For example, a pay line moving left-to-right could start in a top row on the left hand side of the play area and end in a lower row on the right side of a play area.

As demonstrated in FIG. 1E, one or more pay lines can span from one 2D element area, along a 3D portion, to another 2D area, each of the pay lines being composed of a string of adjacent 2D elements and faces of 3D shapes. These pay lines can be predetermined, and a payout issued when all elements and faces of a pay line are correspondingly marked. For example, a payline could be defined or any connection of three correspondingly marked faces between elements 104 and 109, or elements 105 and 107.

Some paylines are only predetermined for which elements are used, and are agnostic to which faces of 3D shapes are used. This is because in various embodiments the 3D structure will move relative to the elements. For example, a pay line may exist between elements 104 and 107, such that any route of corresponding faces facing the same direction as the elements through the 3D cube 150 between elements 104 and 107 are acceptable for triggering a payout if these elements and faces are appropriately marked. This pay line would still exist after the 3D cube 150 is rotated, as explained further herein. In this way, a unique pay line could be defined for each combination of elements on either side of the 3D cube 150 (e.g., a pay line for each unique combination between elements 104-106 and elements 107-109). However, in some embodiment, pay lines are defined not only by which elements they use, but also what 3D shapes and/or faces are used.

In various embodiments, pay lines may need to be enabled for a particular game. For example, a player may be required to place a unique bet for each particular pay line. In such a case, a player not enabling all pay lines may be given the opportunity to select which pay lines will be enabled, wherein only those pay lines that are enabled can be used to form a series of corresponding adjacent elements and faces that triggers a payout. In various embodiments, marked elements and faces will still appear along non-enabled pay lines, but a series of adjacent corresponding elements and faces within those series will not trigger a payout.

It is noted that in the embodiment of FIG. 1E, as well as various others, the elements and faces forming a series of corresponding elements and faces triggering a payout must be adjacent in a two dimensional sense, vertically and horizontally, but not depth-wise along dimension 132 (i.e. the z axis). For example, 3D shapes 114 and 136 are not only in separate layers of the 3D cube, but are two layers apart as 3D shape 114 is on the front layer of the 3D cube and 3D shape 136 is part of the back layer. Therefore in FIG. 1E, 3D shapes 114 and 136 are adjacent when only the vertical and horizontal dimensions are taken into account, but would not be adjacent if the depth dimension 132 was taken into account. While the embodiment of FIGS. 1A-H does not take into account depth when determining adjacency of elements, various other embodiments do. For example, in various embodiments, a winning combination of corresponding adjacent elements is formed by faces that are adjacent horizontally, vertically, and depth-wise for the 3D portion of the series.

FIG. 1E shows identification of a winning series for only one orientation of the 3D cube relative to the element columns 101 and 102. In FIG. 1E, only one face for each 3D shape of the 3D cube 150 are evaluated (i.e. taken into consideration when determining whether a winning series was formed). Each evaluated face is orientated to face the same direction as the 2D elements 104-106 and 107-109 face. Because each 3D shape of the 3D cube 150 has six sides, five faces for each 3D shape remain unevaluated in FIG. 1E. However, the 3D cube 150, and the 3D shapes, can be reoriented to face the same direction as the 2D elements 104-106 and 107-109 to be evaluated, as subsequently shown.

Figure 1F:
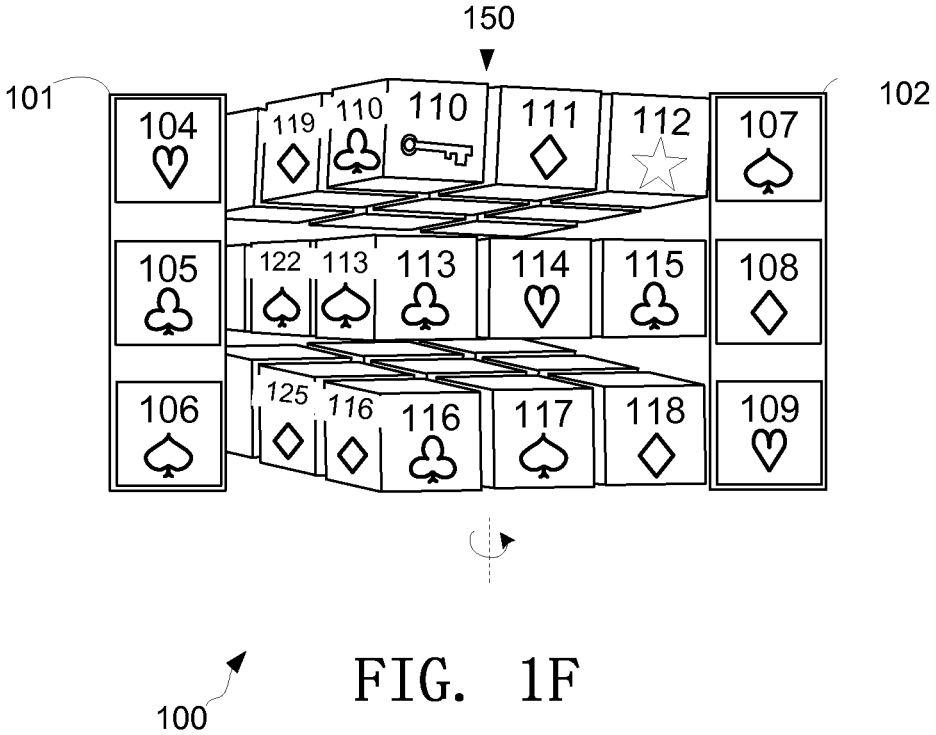

FIG. 1F shows rotation of the 3D cube 150 relative to the two columns of elements 101 and 102 to allow for evaluation of the different faces of the elements of the 3D cube 310. The 3D cube 150 can be rotated in any direction or manner to align the various faces of the 3D cube 150, and the various faces of the 3D shapes, to face the same direction as the 2D elements 104-109, such alignment being a condition for winning series evaluation.

FIG. 1F illustrates rotation of the 3D cube 150, but it is contemplated that other types of movement of the 3D cube 150, and the elements of the 3D cube 150, are contemplated. For example, each of the 3D shapes 110-136 could stay in the same position relative to each other and the element columns 101 and 102 while each of the 3D shapes 110-136 rotate themselves to orientate different faces to face the same direction as the elements 104-109 for winning series identification.

Whether by rotation or some other type of movement, the 3D shapes of a 3D structure can be repositioned relative to 2D elements, but not relative to the other 3D shapes. For example, after each rotation, the faces and markings of the 3D cube 150 will still have the same positioning relative to one another, but will have different positioning with respect to the elements of the element columns 101 and 102, allowing for different marking combinations of the 3D cube 150 to be evaluated with the 2D elements 104-109 with each rotation of the 3D cube 150.

Figure 1G:
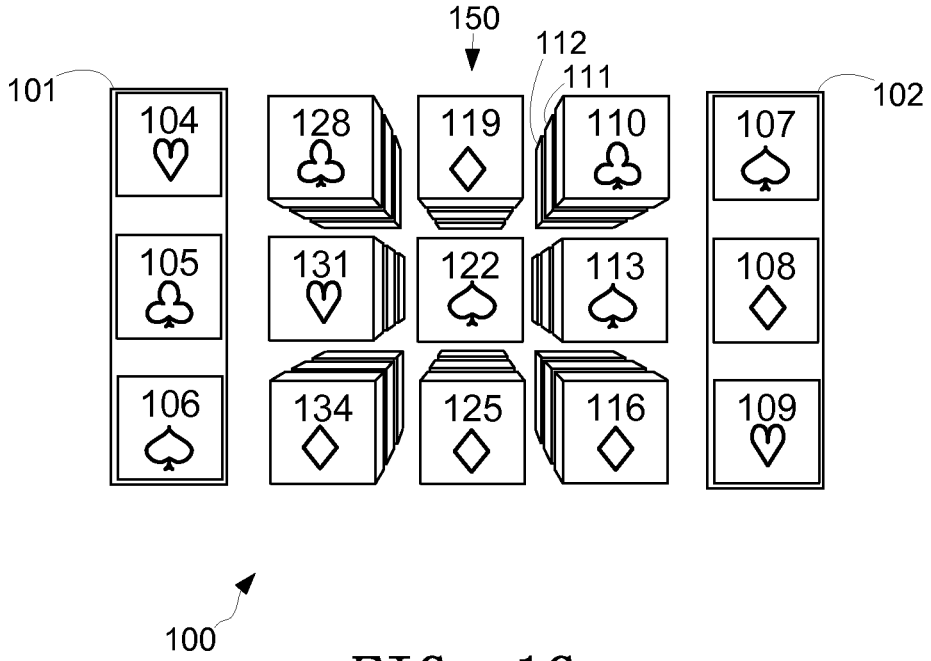
Figure 1H:
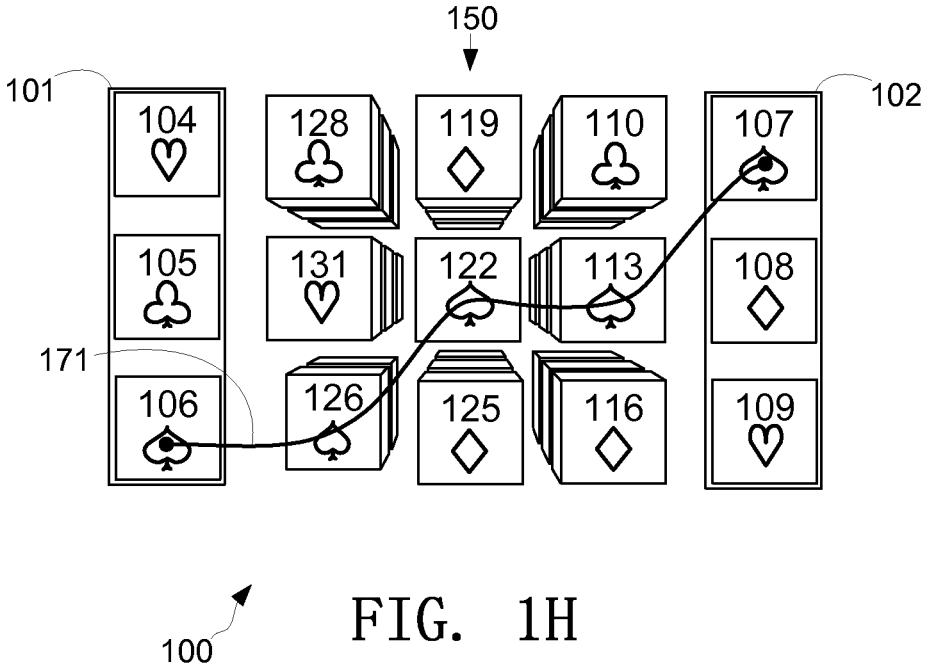

FIG. 1G shows that rotation of the 3D cube 150 has stopped to show another face of the 3D cube 150 and other faces of 3D shapes of the 3D cube 150. For example, a different face of 3D shape 110 is shown in FIG. 1G as was shown in FIGS. 1A-E, these different faces of the same 3D shape 110 being marked with different marking symbols. Therefore, rotation of the 3D cube 150 relative to the 2D elements 104-109 provides a different alignment of faces and markings of the 3D shapes of the 3D cube 150 with the element faces and markings of the 2D elements 104-109. FIG. 1H shows that this different alignment also provides additional opportunities to form winning combinations of corresponding adjacent elements and faces, as shown by line 171 tracing such a winning combination according to a pay table.

The 3D cube 150 can be rotated to match the six different faces of the 3D cube 150 (and the six different faces of each 3D shape of the 3D cube 150) with the 2D elements 104-109. One or more different winning combinations of corresponding adjacent elements can then be identified for each different orientation of the 3D cube 150 with the 2D elements 104-109.

As shown in FIGS. 1A-H, embodiments of the present disclosure involve aspects of both 2D and 3D arrays, and use the additional dimension in the 3D array to allow for different opportunities to form winning combinations of markings. This aspect breaks from the monotonous and predictable manner of conventional game play, as each rotation of the 3D structure relative to the 2D elements provides for additional markings to be considered. Also, game play is drawn out over several stages each game which heightens player anticipation as they watch the game unfold. Moreover, players may view each different alignment of the 3D structure with the 2D elements as a second, third, fourth, etc. chance to form winning combinations of markings after previous alignments failed. Players generally appreciate the perception of being given second chances to finish incomplete symbol combinations.

Various modifications to the embodiments disclosed herein are contemplated. For example, in each orientation of the 3D cube 150 as presented above, all faces of the 3D shapes facing the same direction as the 2D elements are evaluated for winning combinations, regardless of what depth layer (along dimension 132) the face of the 3D shape resides. However, this could be modified such that only the first layer of faces of the 3D shapes are evaluated, and only the faces of the 3D shapes on the face of the 3D cube 310 facing the same direction as the 2D elements are evaluated. In such embodiments, the markings of obscured faces cannot be used, but could be used after the 3D structure is rotated. Such a modification reduces the number of faces, and associated markings, for forming winning combinations.

Another modification removes that requirement that winning combinations be composed of markings of faces of 3D shapes that face the same direction as the 2D elements. In such embodiments, rotation of the 3D cube 150 would be unnecessary.

Although the 3D shapes in FIGS. 1A-H are cubes having faces that are flush, various other embodiments can use 3D shapes without such distinct faces. For example, each of the 3D shapes could be a sphere with multiple markings. The faces in this case are not flush surfaces, but are distinct areas on the 3D shapes on which a marking can be placed. A sphere could still have 6 markings on front, back, top, bottom, left, and right sides, and could be rotated such that each of these sides face the same direction as 2D elements for evaluation in the same manner discussed above.

In another modification, markings could be permanently associated with various faces of each 3D shape (i.e. the markings are hard-wired to the faces). The process of marking can then refer to the scrambling (repositioning) of the faces, and then the results evaluated to identify winning combinations of markings. For example, the 3D shapes could maintain a relative positioning with respect to each other, but the 3D shapes could be rotated in different directions and/or amounts such that some faces that previously faced the same direction no longer face the same direction. The faces can then be evaluated and the 3D structure moved in the same manner discussed above to identify winning combinations, the faces maintaining their relative positioning after scrambling and during the movement and evaluation stages. In some embodiments, scrambling would also include not only rotating the 3D shapes but also repositioning the 3D shapes relative to each other (i.e. some or all of the 3D shapes change position during the "marking" stage).

In FIGS. 1A-H, a winning combination uses 1 marking from each 2D grid location while traversing across the 3D cube 150 (i.e. uses a marking from each of three depth-wise stacks of 3D shapes). In this way, three different markings could be used for each 2D grid location across the 3D cube 150. For example, any of the markings from appropriately orientated faces of 3D shapes 110, 121, and 131 could be used to form a winning combination in the orientation of FIG. 1C, assuming corresponding markings were also positioned elsewhere in the play area 100. This means that two different pay lines could traverse the 2D grid location occupied by 3D shapes 110, 121, and 131 in the orientation of FIG. 1C. Also, two markings from the faces of 3D shapes 110, 121, and 131 could be used in the same pay line that traverses the 2D grid location occupied by 3D shapes 110, 121, and 131 (e.g., two identical markings could alternatively be used to complete a winning combination). Different rules could be applied to account for such situations. In some embodiments, only the particular series associated with the highest payout value will be recognized to trigger a payout. In some other embodiments, all series of marking combinations that correspond to a pay table will be recognized and trigger respective payouts.

Figure 2:
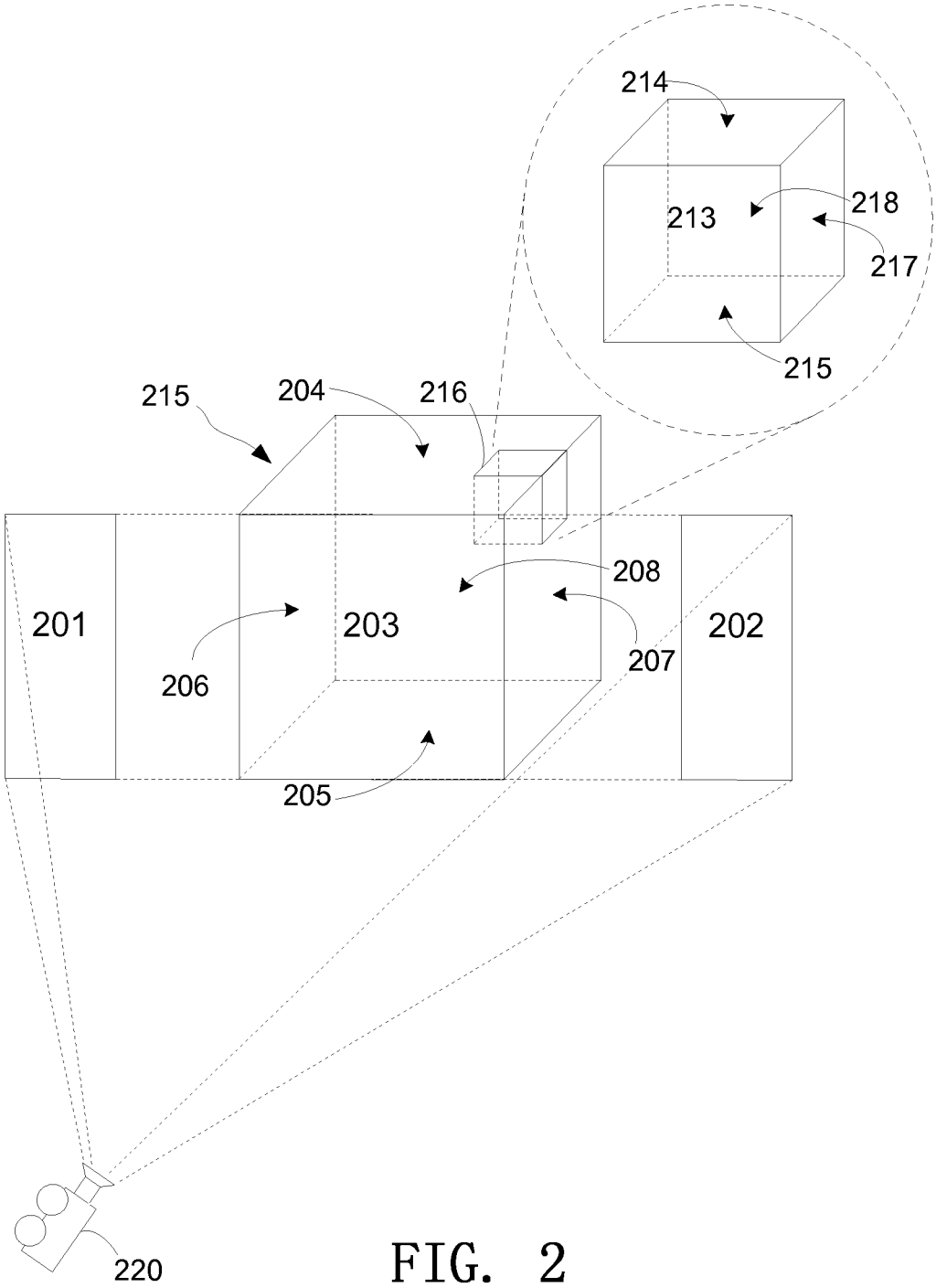
FIG. 2 illustrates an embodiment of a gaming activity spanning 2D and 3D play areas in accordance with aspects of the invention.

FIG. 2 illustrates aspects of the present disclosure. FIG. 2 represents a pulled-back perspective view of the embodiment of FIGS. 1A-H. FIG. 2 includes a 2D portion composed of 2D element areas on either side of a 3D element portion. The 2D element columns 201 and 202 correspond to the two element columns 101 and 102 of FIGS. 1A-H and the 3D cube 215 corresponds to the 3D cube 115 having 3D shapes.

While the viewing perspective in FIGS. 1A-H was aligned straight on with the front of the 3D cube 115 and the two element columns 101 and 102, a different perspective is used in FIG. 2. FIG. 2 shows camera 220 to represent the perspective used in FIGS. 1A-H, so that the alignment of the 3D cube 115 and the two element columns 101 and 102 can be better understood. As shown in FIG. 2, the front side 203 of the 3D cube 215 is aligned with the two element columns 201 and 202. The camera 220 representing a user's perspective is shown because it is the perspective of the camera 220 that is used to determine which faces will be evaluated, where those faces of the 3D shape not facing the camera 220 are not evaluated and those faces that face the camera 220 are evaluated. However, various embodiments use additional or alternative rules for deciding when faces of 3D shapes are evaluated for winning combinations for each orientation.

The 3D cube 215 is composed of multiple elemental 3D cubes, such as cube 216. Cube 216 is shown enlarged in FIG. 2, with front side 213, left side 216, right side 217, bottom side 215, top side 214, and back side 218 indicated. The 3D shapes of the 3D cube 215 are orientated in the same manner as the 3D cube itself. For example, cube 216 is orientated in the same manner such that the front side 213 faces the same direction as the front side 203 of the 3D cube 215, the left side 216 of the faces the same direction as the left side 206 of the 3D cube 215, the right side 217 faces the same direction as the right side 207 of the 3D cube 215, the bottom side 215 faces the same direction as the bottom side 205 of the 3D cube 215, the top side 214 faces the same direction as the top side 204 of the 3D cube 215, and the back side 218 faces the same direction as the back side 208 of the 3D cube 215. These same relationships are maintained upon rotation of the 3D cube 215, which allows the different faces of each elemental cube (e.g., faces 213-218 of cube 216) to face the same direction as the elements of the two element columns 201 and 202 and are orientated parallel with the elements of the two element columns 201 and 202.

In various embodiments, it is the particular sides of a 3D shapes forming a 3D structure (e.g., the 3D cube 215) that face the same direction as stationary 2D elements (e.g., of the two element columns 201 and 202) that are evaluated for winning element combinations. The different sides of the elemental 3D shapes of the 3D structure are evaluated in combination with the stationary 2D elements by movement of the 3D shapes of the 3D structure relative to the stationary 2D elements such that each side will be evaluated for winning element combinations when the side of each 3D shape is facing the same direction as the stationary 2D elements and/or is orientated parallel with the stationary 2D elements.

Therefore, the markings on sides 214-218 are not evaluated for winning combinations when the front side 213 faces the same direction as the stationary 2D element columns 201 and 202, as sides 214-218 are not facing the same direction as the elements of the stationary 2D element columns 201 and 202. The respective marking for each of these sides 214-218 will be individually evaluated when the 3D cube 215 moves and each side is respectively oriented in the same manner as front side 213 is shown in FIG. 2 (facing the same direction as the 2D elements), only one side of each 3D elemental cube being evaluated for each orientation of the 3D cube 215. During each of these individual evaluations, the markings of the sides of elements not facing the same direction as the 2D elements and/or orientated parallel with the 2D elements will not be evaluated.

As shown in FIG. 2, the 3D cube 215 has six orientations with respect to the 2D elements of the 2D element columns 201 and 202 that align a face of the 3D cube (and respective faces of the elemental cubes forming the 3D cube 215) with the 2D element columns 201 and 202. However, the number of different matching orientations can change depending on the shape of the 3D shapes composing and the 3D cube 215. Additionally, although a 3D cube 215 is illustrated in FIG. 2, other 3D structures composed of 3D shapes can be used. In some embodiments, the elemental shapes composing the 3D structure are the same shape as that of the 3D structure, albeit of a smaller size. In some other embodiments, the elemental shapes composing the 3D structure do not resemble the same shape as that of the 3D structure.

Figure 3:
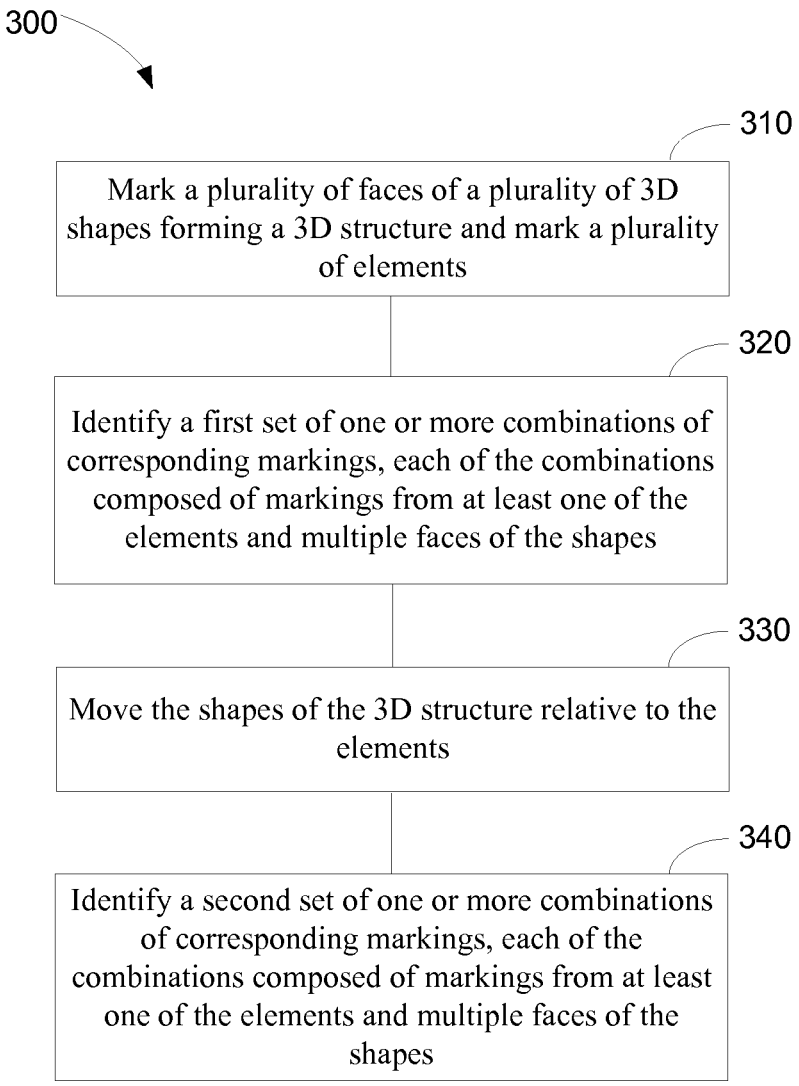
FIG. 3 is a flow diagram of an exemplary embodiment of a method for facilitating a game spanning 2D and 3D areas in accordance with aspects of the invention.

FIG. 3 shows a flow chart of a method 300 of facilitating a game using 2D and 3D aspects. The method 300 can correspond to the embodiment of FIGS. 1A-2. The method 300 includes marking 310 a plurality of faces of a plurality of three dimensional shapes forming a 3D structure and marking a plurality of elements. The 3D shapes can be cubes, as illustrated in FIG. 1A-2, or other 3D shapes. The 3D structure can be a 3D cube, as in FIG. 1A-2, or other 3D structure. Marking 310 of the faces and elements can be done in any manner referenced herein.

The method 300 further includes identifying 320 a first set of one or more combinations of corresponding markings, each of the combinations composed of markings from at least one of the elements and multiple faces of the shapes. Each of these combinations can be winning combinations of markings formed according to various rules referenced herein. For example, each combination may need to be a series of corresponding elements and faces, the series being a string of adjacent faces between two elements, the elements and faces corresponding based on being commonly marked 310 (e.g., marked with the same symbol-type). In this way, the elements of the series bookend the portion of the series composed of the faces of the 3D shapes.

The method 300 further includes moving 330 the shapes of the 3D structure relative to the elements. Such motion 330 can be that seen and described in relation to FIG. 1F, or other forms of movement referenced herein. In various embodiments, the elements remain stationary while the 3D shapes rotate. The movement can align a different set of faces of the 3D shapes with the elements, the different set not previously being evaluated for identification 320.

The method 300 further includes identifying 340 a second set of one or more combinations of corresponding markings, each of the combinations composed of markings from at least one of the elements and multiple faces of the shapes. Identifying 340 the second set can be done in the same or different manner than identifying 320 the first set. However, even if the rules for winning series formation are the same between evaluations 320 and 340, different combinations of faces will be evaluated for identification 340 of the second set as compared to identification 320 for the first set because of the movement 330 of the shapes relative to the elements.

Figure 4:
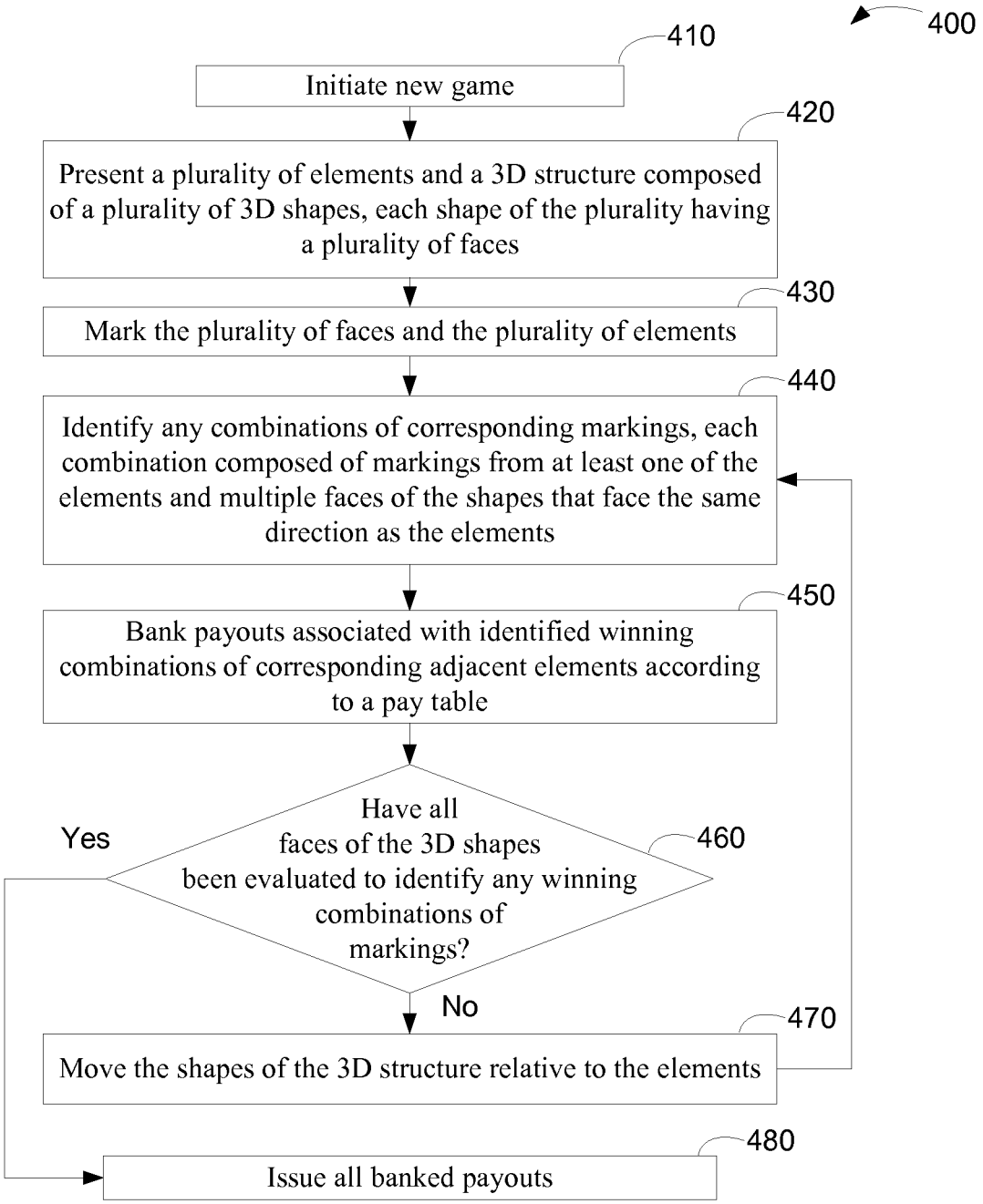
FIG. 4 is a flow diagram of an exemplary embodiment of a method for facilitating a game spanning 2D and 3D areas in accordance with aspects of the invention.

FIG. 4 illustrates a flow chart of a method 400 for facilitating a game having 2D and 3D aspects. FIG. 4 can correspond to the embodiments of FIGS. 1A-3, but further highlighting how game stages can be repeated and partial payouts accumulated over the course of a game.

The method 400 includes initiating 410 a new game. Initiating 410 a new game can include clearing a play area of markings and/or resetting a default orientation of a 3D structure. A game may be initiated 410 based on a wager, in which the wager is placed at stake pending the outcome of the game.

The method 400 includes presentation 420 of a plurality of elements and a 3D structure composed of a plurality of 3D shapes, each shape of the plurality having a plurality of faces. The elements could be the 2D elements 104-109 of FIGS. 1A-H. The 3D structure could correspond to the 3D cubes 150 and 210 and the 3D shapes can correspond to the 3D elemental cubes of FIGS. 1A-2.

The presented 420 plurality of faces and the plurality of elements can be marked 430. Marking 430 can be done in any manner referenced herein, including adding respective symbols to the faces and elements. Combinations of these markings are then identified 440, each combination composed of markings from at least one of the elements and multiple faces of the shapes that face the same direction as the elements. For example in various embodiments, the elements can be presented 420 on opposite sides of the 3D structure, such that an identified 440 winning combinations must be a series composed of two elements from opposite sides of the 3D structure, the series spanning across the 3D structure using markings of faces of 3D shapes composing the 3D structure, as in FIGS. 1A-H. The elements and faces may correspond by being commonly (e.g., identically) marked, and the series may need to be composed of adjacent elements and faces. For each identified 440 combination, a payout according to a pay table is banked 450.

The method 400 considers whether all faces of the 3D shapes have been evaluated to identify 440 any winning combinations of markings, as shown in step 460. Step 470 moves the shapes of the 3D structure relative to the elements. Such movement 470 can be the rotation shown in FIG. 1F or other movement as referenced herein. Considering that each 3D shape has a plurality of faces, the method 400 must loop through steps 440-450-460-470 multiple times to satisfy the conditions of step 460 and advance to step 480.

After the conditions of step 460 have been satisfied, meaning all faces of the 3D shapes have been evaluated 470 for potential winning combinations, the method 400 issues 480 all banked payouts.

The conditions of step 460 could be modified. For example, instead of requiring that all faces be evaluated, the conditions of step 460 could be satisfied by identification 440 of a winning combination, such that the game comes to an end 480 if a win is identified or none of the orientations of the 3D structure provide a winning combination with the elements.

In various embodiments, the movement 470 of the shapes may require an additional wager to unlock the various faces and/or sides of the 3D structure. For example, a minimum wager may allow only evaluation 440 of one side of the 3D structure, while incrementally larger wagers may allow movement 470 for alignment with the plurality of elements and evaluation 440 of additional sides. In the case of a cube, six levels of wagering may unlock evaluation 440 from all six perspectives of the cube for a single spin.

Figure 5:
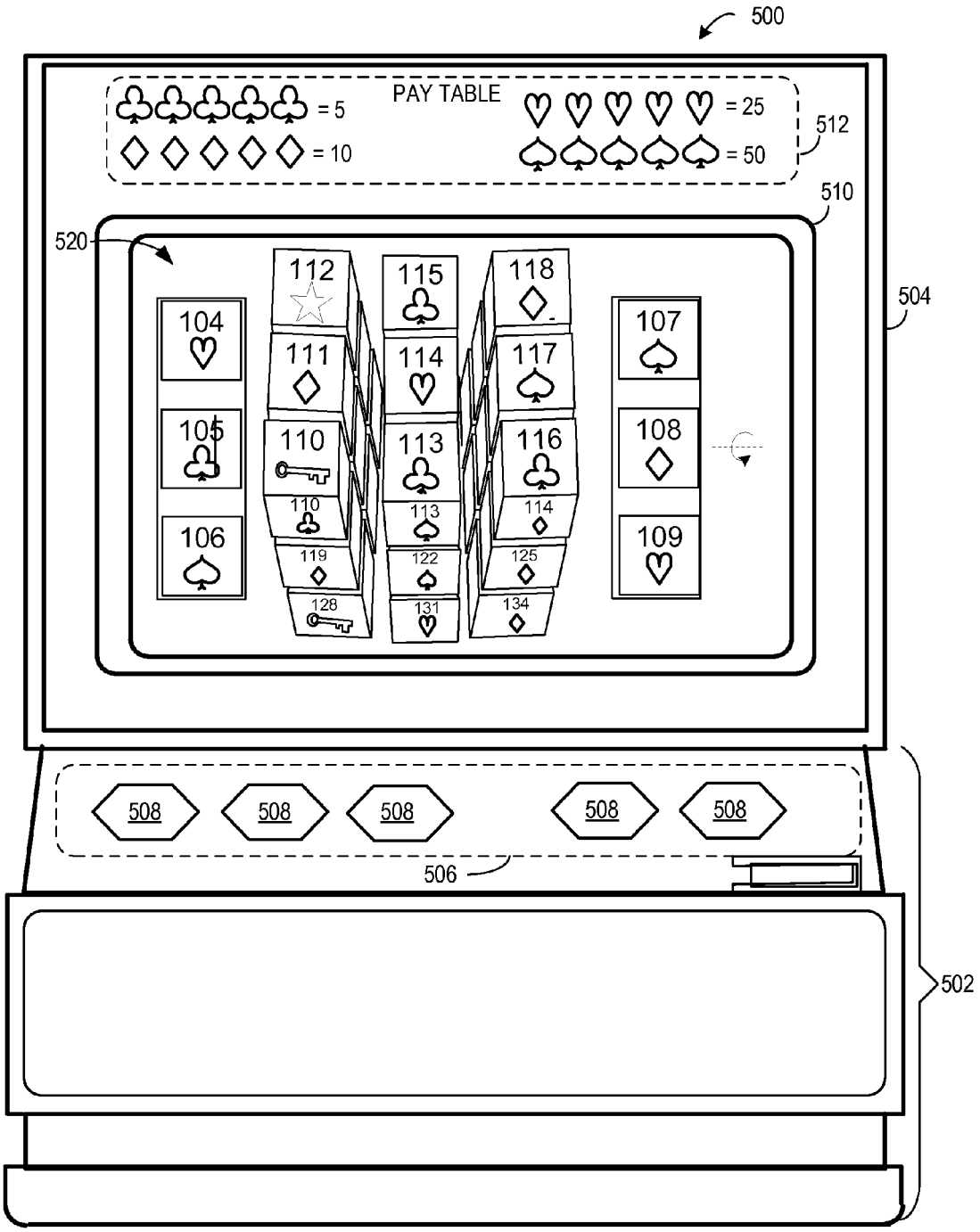
FIG. 5 is an embodiment of a casino-style gaming device in which the principles of the present invention may be applied.

FIG. 5 is an embodiment of a casino-style gaming device in which the principles of the present invention may be applied. The slot machine 500 is a structure including at least a computing system, a housing, and a display. The housing includes a base 502 and a display device 504 to allow the slot machine 500 to be a self-supported, independent structure. The base 502 includes structure supporting the slot machine 500, and also includes a user interface 506 to allow the user to control and engage in play of the slot machine 500. The particular user interface mechanisms associated with user interface 506 is dependent on the type of gaming machine. For example, the user interface 506 may include one or more buttons, switches, joysticks, levers, pull-down handles, trackballs, voice-activated input, or any other user input system or mechanism that allows the user to participate in the particular gaming activity. The user input 506 allows the user to enter coins or otherwise obtain credits through vouchers, tokens, credit cards, etc. Various mechanisms for entering such vouchers, tokens, credit cards, coins, point tickets, etc. are known in the art. For example, coin/token input mechanisms, card readers, credit card readers, smart card readers, punch card readers, and other mechanisms may be used to enter wagers. The user input may include a plurality of buttons 508, which allow the user to initiate game play, enter a number of credits to play, select options, cash out, automatically bet the maximum amount, etc. It should be recognized that a wide variety of other user interface options are available for use, including pressing a button on a gaming machine, touching a segment of a touch-screen, entering text, entering voice commands, or other known user entry methodology.

User inputs can be used to manipulate the moveable 3D structure and 3D shapes discussed above. For example, a user input can initiate and/or control movement of the 3D cube 150 to re-orientate the 3D cube 150. User input could also make 3D shapes invisible or in some manner facilitate user inspection of the markings of the 3D cube 150. For example, using a touch screen a user could hold a finger over a 3D shape for a predetermined amount of time making the 3D shape disappear.

The display device 504 of FIG. 5 includes a display screen 510. The display device may take on a variety of forms depending on what type of presentation is to be provided. For example, a slot game play area 520 is provided where the slot gaming activity in accordance with the invention is displayed. The slot game play area 520 can function as the play area described herein. The video display screen may be implemented in a variety of manners, including electronically represented with outputs shown on conventional electronic displays, such as a liquid crystal displays (LCD), dot matrix, plasma, CRT, LED, electro-luminescent display, or generally any type of video display known in the art.

Various types of play area, and ways to display them, are contemplated in the scope of the invention, including vertical, horizontal, and/or diagonal lines creating spaces of rectangles and/or squares and 3D matrices. A display grid could also be comprised of triangles, hexagons, ovals, circles and other shapes.

A play area can be presented in various ways. For example, a play area could be comprised of several reel strips with various markings on the periphery of the reel strips. Several reel strips with a common axis placed together can form a grid, with each reel strip representing a vertical column and adjacent markings on the aligned reels representing a horizontal row, with a 3D structured represented between or amongst the reel strips. A play area could also be represented by projected light.

A play area can also be presented by use of video means, such as with a video slot machine. In a video slot machine, the elements and/or 3D structure are not represented by physical material, but rather include electronically stored symbol patterns, i.e., a virtual reel strip and structure. By using virtual reel strips and 3D structure, there is no physical correlation between display series of vertical columns as there are with mechanical reel strips. For example, in the context of mechanical reel strips, three symbols presented in a column across three pay lines are physically restricted to that particular order, since the reel strip is presented across three rows. Furthermore, there are other advantages by using video representation, including faster game play, greater flexibility in game types and variations, and representation of things that would otherwise be physically complicated or impossible.

Associated with the display device 504 is an optional winning guide area 512, where information associated with the potential winning series lengths may be presented. This area may also provide an indication of the requisite markings, marking lengths, marking combinations, marking locations, etc. that result in winning payouts to the participant. This information may be part of the display screen 510, or alternatively may be separate from the display screen 510 and provided directly on a portion of the display device 504 structure itself. For example, a backlit colored panel may be used as the winning guide area 512. Further, this information may be provided on an entirely separate display screen (not shown). The winning guide area 512 can display pay table information, as shown.

The gaming machines described in connection with the present invention may be independent casino gaming machines, such as slot machines or other special purpose gaming kiosks, video games, or may be computing systems operating under the direction of local gaming software and/or remotely-provided software such as provided by an application service provider (ASP). The casino gaming machines utilize computing systems to control and manage the gaming activity. An example of a representative computing system capable of carrying out operations in accordance with the invention is illustrated in FIG. 6.

Hardware, firmware, software or a combination thereof may be used to perform the various gaming functions, display presentations and operations described herein. The functional modules used in connection with the invention may reside in a gaming machine as described, or may alternatively reside on a stand-alone or networked computer. The computing structure 600 of FIG. 6 is an example computing structure that can be used in connection with such electronic gaming machines, computers, or other computer-implemented devices to carry out operations of the present invention.

The example computing arrangement 600 suitable for performing the gaming activity utilizing expanding arrays and series of corresponding adjacent elements in accordance with various embodiments typically includes a central processor (CPU) 602 coupled to random access memory (RAM) 604 and some variation of read-only memory (ROM) 606. The ROM 606 may also be other types of storage media to store programs, such as programmable ROM (PROM), erasable PROM (EPROM), etc. The processor 602 may communicate with other internal and external components through input/output (I/O) circuitry 608 and bussing 610, to provide control signals, communication signals, and the like.

Figure 6:
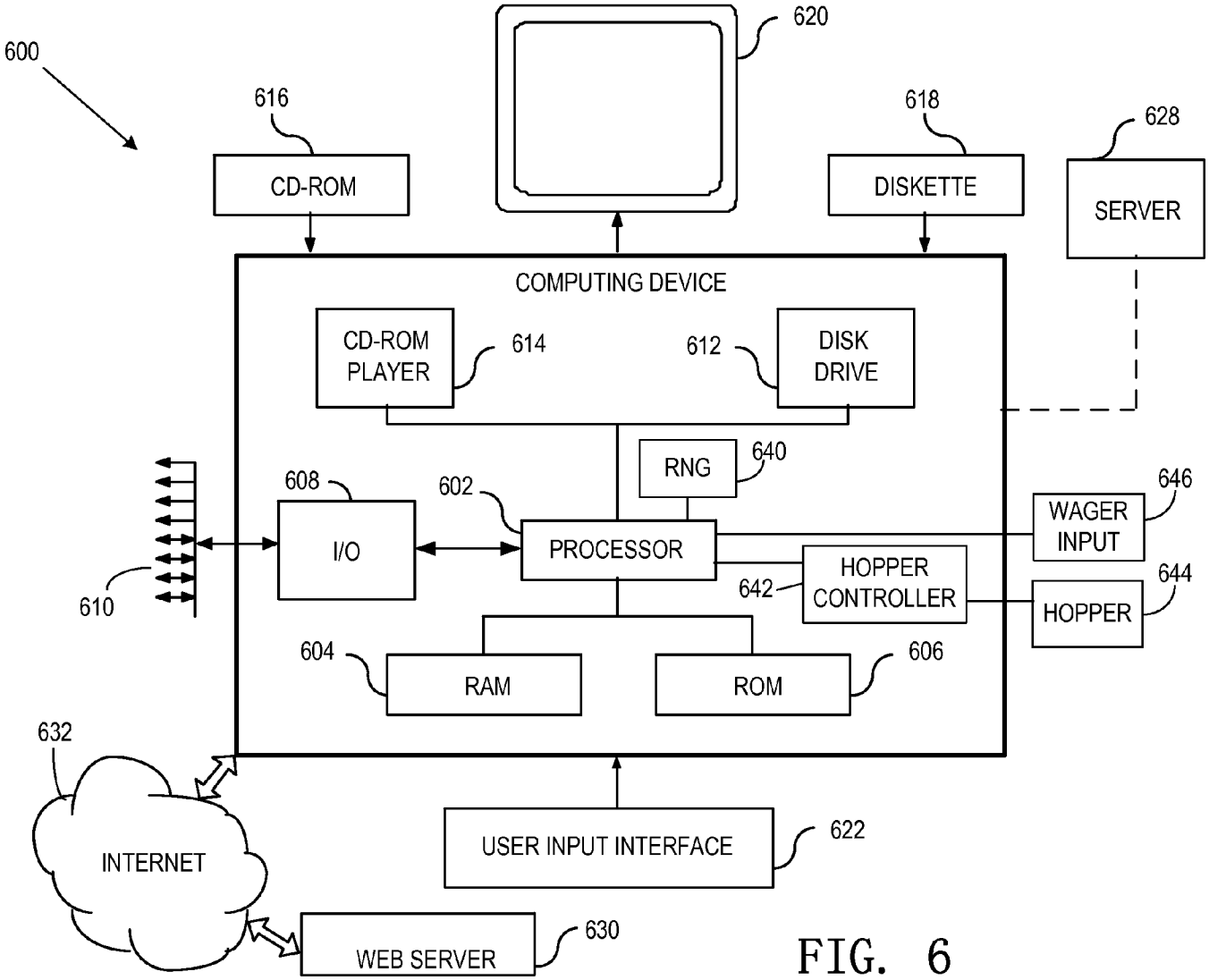
FIG. 6 illustrates circuitry capable of carrying out operations in accordance with aspects of the invention.

The circuitry represented in FIG. 6 can be wholly or partially housed within the embodiment of FIG. 6 and used to perform the various methodologies and techniques discussed herein (e.g., carry out the methods of FIGS. 3 and/or 5 to provide the game play aspects exhibited in FIGS. 1A-B, 2A-B, and/or 4A-H). RAM 604 and/or ROM 606 can be a computer readable medium encoded with a computer program, software, firmware, computer executable instructions, instructions capable of being executed by a computer, etc. to be executed by circuitry, such as processor 602. For example, RAM 604 and/or ROM 606 can be a computer readable medium storing a computer program, execution of the computer program by processor 602 causing presentation of a representation of a three dimensional structure composed of a plurality of 3D shapes, each shape of the plurality having a plurality of faces; presentation of a plurality of elements; marking the plurality of faces and the plurality of elements; identification of a first set of one or more combinations of corresponding markings, each of the combinations of corresponding markings from the first set composed of markings from at least one of the elements and multiple faces of the shapes; movement of the shapes of the 3D structure relative to the elements; and identification of a second set of one or more combinations of corresponding markings, each of the combinations of corresponding markings from the second set composed of markings from at least one of the elements and multiple faces of the shapes. In similar ways, the other methods and techniques discussed herein can be performed using the circuitry represented in FIG. 6.

The exemplary device includes a processing/control unit (e.g., 602), such as a microprocessor, reduced instruction set computer (RISC), or other central processing module. The processing unit need not be a single device, and may include one or more processors. For example, the processing unit may include a master processor and one or more associated slave processors coupled to communicate with the master processor.

Chance-based gaming systems such as slot machines, in which the present invention is applicable, are governed by random numbers and processors. Electronic reels are used to display the result of the digital reels which are actually stored in computer memory and "spun" by a random number generator (RNG). RNGs are understood in the art, and may be implemented using hardware, software operable in connection with the processor 602, or some combination of hardware and software. In accordance with generally known technology in the field of slot machines, the processor 602 associated with the slot machine, under appropriate program instruction, can simulate the vertical rotation of multiple reels and rotation or other movement of a 3D arrangement of 3D shapes. Generally, the RNG continuously cycles through numbers, even when the machine is not being played. The slot machine selects, for example, three random numbers. The numbers chosen at the moment the play is initiated are typically the numbers used to determine the final outcome, i.e., the outcome is settled the moment the reels are spun. The resulting random numbers are generally divided by a fixed number. This fixed number is often thirty-two, but for slot machines with large progressive jackpots it may be even greater. After dividing, the remainders will be retained. For example, if the divisor was one-hundred twenty-eight, the machine would have three remainders ranging from zero to one-hundred twenty-seven. The remainders may be considered as stops on virtual reels. If the divisor was one-hundred twenty-eight, then the virtual reels would each have one-hundred twenty-eight stops with each stop being equally likely. Each stop on the virtual reel may be mapped to a stop on an actual reel or displayed reel image. These reel images may then be displayed on the display 640. The present invention is operable using any known RNG, and may be integrally programmed as part of the processor 602 operation, or alternatively may be a separate RNG controller 640. RNGs are well known in the art, and any type of RNG may be implemented for the standard mode of play and/or the bonus mode of play in accordance with the invention. Such methods and devices can be used to select elements and/or markings, among other things.

The computing arrangement 600 may also include one or more data storage devices, including hard and floppy disk drives 612, CD-ROM drives 614, and other hardware capable of reading and/or storing information such as DVD, etc. In one embodiment, software for carrying out the gaming operations in accordance with the present invention may be stored and distributed on a CD-ROM 616, diskette 618 or other form of media capable of portably storing information. These storage media may be inserted into, and read by, devices such as the CD-ROM drive 614, the disk drive 612, etc. The software may also be transmitted to the computing arrangement 600 via data signals, such as being downloaded electronically via a network, such as the Internet. Further, as previously described, the software for carrying out the functions associated with various embodiments may alternatively be stored in internal memory/storage of the computing device 600, such as in the ROM 606. The computing arrangement 600 is coupled to the display 640, which represents a display on which the gaming activities in accordance with the invention are presented. The display 640 merely represents the "presentation" of the video information in accordance with the invention, and may be any type of known display or presentation screen, such as LCD displays, plasma display, cathode ray tubes (CRT), etc. Where the computing device 600 represents a stand-alone or networked computer, the display 640 may represent a standard computer terminal or display capable of displaying multiple windows, frames, etc. Where the computing device is embedded within an electronic gaming machine, such as slot machine 500 of FIG. 6, the display 640 corresponds to the display screen 510 of FIG. 5. A user input interface 622 such as a mouse or keyboard may be provided where the computing device 600 is associated with a standard computer. An embodiment of a user input interface 622 is illustrated in connection with an electronic gaming machine 500 of FIG. 6 as the various "buttons" 508. Other user input interface devices include a keyboard, a mouse, a microphone, a touch pad, a touch screen, voice-recognition system, etc.

In various embodiments of the invention, various aspects of the game, as described herein, may be player controlled. For example, a player may place bets, select game types, select play area types, select grid types, select array types, select themes, select symbols, select elements, select colors, and/or select markings.

The computing arrangement 600 may be connected to other computing devices or gaming machines, such as via a network. The computing arrangement 600 may be connected to a network server 628 in an intranet or local network configuration. The computer may further be part of a larger network configuration as in a global area network (GAN) such as the Internet. In such a case, the computer accesses one or more web servers 630 via the Internet 632.

Other components directed to slot machine implementations include manners of gaming participant payment, and gaming machine payout. For example, a slot machine including the computing arrangement 600 may also include a hopper controller 642 to determine the amount of payout to be provided to the participant. The hopper controller may be integrally implemented with the processor 602, or alternatively as a separate hopper controller 642. A hopper 644 may also be provided in slot machine embodiments, where the hopper serves as the mechanism holding the coins/tokens of the machine. The wager input module 646 represents any mechanism for accepting coins, tokens, coupons, bills, credit cards, smart cards, membership cards, etc. for which a participant inputs a wager amount.

Using the foregoing specification, the invention may be implemented as a machine, process, or article of manufacture by using standard programming and/or engineering techniques to produce programming software, firmware, hardware or any combination thereof.

Any resulting program(s), having computer-readable program code, may be embodied within one or more computer-usable media such as memory devices or transmitting devices, thereby making a computer program product or article of manufacture according to the invention. As such, the terms "article of manufacture" and "computer program product" as used herein are intended to encompass a computer program existent (permanently, temporarily, or transitorily) on any computer-usable medium such as on any memory device or in any transmitting device.

The present invention is applicable to various gaming activities that are played on a gaming board or gaming machine, including slot games such as reel slots and video slots, and other games utilizing corresponding grid elements to generate a game result. The present invention is described in terms of slot machines to provide an understanding of the invention. While the invention is particularly advantageous in the context of slot machines, and while a description in terms of slot machines facilitates an understanding of the invention, the invention is also applicable to other gaming activities of chance utilizing symbol strings as will be readily apparent to those of skill in the art from the description provided herein.

The circuitry represented in FIG. 6 can be used to perform the various methodologies and techniques discussed herein. For example, RAM 604 can be a computer readable medium encoded with a computer program, software, computer executable instructions, instructions capable of being executed by a computer, etc., to be executed by circuitry, such as processor 602, to cause the various other components, such as user input 622, display 640, hopper controller 642 and hopper 644, RNG 670, etc. to perform the various operations discussed herein.

One skilled in the art of computer science from the description provided herein will be able to combine the software created as described with appropriate general purpose or special purpose computer hardware to create a computer system and/or computer subcomponents embodying the invention, and to create a computer system and/or computer subcomponents for carrying out methods of the invention.

The foregoing description of the exemplary embodiment of the invention has been presented for the purposes of illustration and description. It is not intended to be exhaustive or to limit the invention to the precise form disclosed. Many modifications and variations are possible in light of the above teaching. For example, the present invention is not limited to what is traditionally known as "slot machines." Also, while the illustrated embodiments have been described in large part in connection with a "slot machine," other gaming systems and concepts are also within the scope of the invention, such as video poker games, card games, lotteries, and other casino events implementing a video screen. For example, a video poker game may utilize the present invention to provide multiple cards at each standard card display segment. It is thus intended that the scope of the invention be limited not with this detailed description, but rather by the claims appended hereto.

The invention claimed is:

1. A method of operating a gaming apparatus having a display device configured to display a game of chance, a wager input device structured to receive currency or currency based tickets, a memory configured to store a credit amount, and a processor, the method comprising:

receiving a signal from the wager input device indicating receipt of currency or a currency based ticket;

increasing the credit amount in memory based on the received signal from the wager input device;

receiving a wager to initiate the game of chance on the display device, the wager decreasing the credit amount in memory, the game of chance including displaying on the display device a first reel, a second reel, a third reel, a fourth reel, and a fifth reel, where the first reel and the fifth reel each respectively include a plurality of vertical symbol positions that are configured to display game symbols, where the second reel, third reel, and fourth reel each respectively include a plurality of three-dimensional game elements having six sides that collectively form a three-dimensional structure having six sides, where the three-dimensional structure includes at least three layers of the game elements in a depth direction, where the three-dimensional structure includes at least three adjacent game elements in vertical direction, at least three adjacent game elements in a horizontal direction, and at least three game elements in the depth direction, where the three-dimensional structure is configured to be rotatable about a vertical axis and rotatable about a horizontal axis, and where sides of the plurality of game elements are configured to display game symbols;

selecting symbols to be displayed on the display device for the first reel, the second reel, the third reel, the fourth reel, and the fifth reel; and evaluating symbol combinations formed from symbols displayed on the first reel, the second reel, the third reel, the fourth reel, and the fifth reel.

2. The method of claim 1, wherein the three-dimensional structure formed by the game elements of the second reel, third reel, and fourth reel is cube-shaped.

3. The method of claim 2, wherein the three-dimensional structure formed by the game elements of the second reel, third reel, and fourth reel includes twenty seven of the six-sided game elements.

4. The method of claim 2, further comprising:

rotating the three-dimensional structure after evaluating the symbols combinations to display different game symbols on the second reel, third reel, and fourth reel; and re-evaluating symbol combinations formed from symbols displayed on the first reel, the second reel, the third reel, the fourth reel, and the fifth reel.

5. The method of claim 4, further comprising continuing to rotate the three-dimensional structure and evaluating symbols combinations until each of the six sides of the cubed-shaped three-dimensional structure has had associated symbols evaluated along with the symbols displayed on the first reel and fifth reel.

6. The method of claim 1, wherein the three-dimensional structure includes a first layer of game elements, a second layer of game elements positioned under the first layer of game elements in a depth direction, and a third layer of game elements positioned under the second layer of game elements in depth direction.

7. The method of claim 6, wherein at least some of the game elements in the second layer of game elements are at least partially visibly displayed on the display device.

8. The method of claim 1, where the three-dimensional structure is displayed in a three-dimensional view so that at least some of the game symbols along sides of the three-dimensional structure are visibly displayed on the display device.

9. The method of claim 1, further comprising:

rotating the three-dimensional structure after evaluating the symbols combinations to display different game symbols on the second reel, third reel, and fourth reel; and re-evaluating symbol combinations formed from symbols displayed on the first reel, the second reel, the third reel, the fourth reel, and the fifth reel.

10. The method of claim 9, wherein the three-dimensional structure is rotated and the symbol combinations are re-evaluated only when a predefined criterion is satisfied.

11. The method of claim 1, where each side of each game element in the plurality of game elements in the three-dimensional structure is associated with selected game symbols.

12. The method of claim 1, where only sides of game elements that are co-planar with sides of the three-dimensional structure are associated with selected game symbols.

13. The method of claim 1, where each of the plurality of three-dimensional game elements are independently rotatable with respect to other ones of the plurality of three-dimensional game elements.

14. A method of operating a gaming apparatus having a display device including a video screen having a game play grid showing portions of a first reel, a second reel, a third reel, a fourth reel, and a fifth reel, where the first reel and the fifth reel each respectively include a plurality of vertical symbol positions that are configured to display game symbols, where the second reel, the third reel, and the fourth reel each respectively include a plurality of three-dimensional game elements having six sides that collectively form a three-dimensional structure having six sides, where the three-dimensional structure includes at least three layers of the game elements in a depth direction, where the three-dimensional structure includes at least three adjacent game elements in a vertical direction, at least three adjacent game elements in a horizontal direction, and at least three game elements in the depth direction, where the three-dimensional structure is configured to be rotatable about a vertical axis and rotatable about a horizontal axis, and where sides of the plurality of game elements are configured to display game symbols, the gaming apparatus also including a processor, the method comprising:

receiving a wager to initiate the game of chance on the display device;

selecting symbols to be displayed on the display device for the first reel, the second reel, the third reel, the fourth reel, and the fifth reel; and evaluating symbol combinations formed from symbols displayed on the first reel, the second reel, the third reel, the fourth reel, and the fifth reel.

15. A method of operating a gaming apparatus having a display device including a video screen having a game play grid showing portions of a first reel, a second reel, a third reel, a fourth reel, and a fifth reel, where the first reel and the fifth reel each respectively include a plurality of vertical symbol positions that are configured to display game symbols, where the second reel, the third reel, and the fourth reel each respectively include a plurality of three-dimensional game elements having six sides that collectively form a three-dimensional structure having six sides, where the three-dimensional structure includes at least three layers of the game elements in a depth direction, where the three-dimensional structure includes at least three adjacent game elements in a vertical direction, at least three adjacent game elements in a horizontal direction, and at least three game elements in the depth direction, where the three-dimensional structure is configured to be rotatable about a vertical axis and rotatable about a horizontal axis, and where sides of the plurality of game elements are configured to display game symbols, the gaming apparatus also including a processor, the method comprising:

receiving a wager to initiate the game of chance on the display device;

selecting symbols to be displayed on the display device for the first reel, the second reel, the third reel, the fourth reel, and the fifth reel;

evaluating symbol combinations formed from symbols displayed on the first reel, the second reel, the third reel, the fourth reel, and the fifth reel to determine a first prize;

rotating the three-dimensional structure about one of the vertical axis or horizontal axis to display a different set of symbols on the second reel, the third reel, and the fourth reel;

evaluating symbol combinations formed from symbols displayed on the first reel, the second reel, the third reel, the fourth reel, and the fifth reel after the rotation of the three-dimensional object to determine a second prize; and awarding a combination of the first prize and the second prize.

16. The method of claim 15, further comprising:

rotating the three-dimensional structure a second time about one of the vertical axis or horizontal axis to display a second different set of symbols on the second reel, the third reel, and the fourth reel;

evaluating symbol combinations formed from symbols displayed on the first reel, the second reel, the third reel, the fourth reel, and the fifth reel after the second rotation of the three-dimensional object to determine a third prize; and awarding a combination of the first prize, the second prize, and third prize.

17. The method of claim 16, wherein the three-dimensional structure is repeatedly rotated and symbol combination are evaluated from symbols displayed on the first reel, the second reel, the third reel, the fourth reel, and the fifth reel after the second rotation of the three-dimensional object to determine additional prizes until all sides of the three-dimensional structure have been displayed and evaluated.

18. The method of claim 17, wherein all prizes determined from the evaluations are awarded.

19. The method of claim 15, wherein the three-dimensional structure includes a first layer of game elements, a second layer of game elements positioned under the first layer of game elements in a depth direction, and a third layer of game elements positioned under the second layer of game elements in depth direction.

20. The method of claim 19, wherein at least some of the game elements in the second layer of game elements are at least partially visibly displayed on the display device.

* * * * *